US009722375B2

(12) United States Patent
Chang et al.

(10) Patent No.: US 9,722,375 B2
(45) Date of Patent: Aug. 1, 2017

(54) ELECTRICAL CONNECTOR FOR USE WITH CRADLE

(71) Applicant: FOXCONN INTERCONNECT TECHNOLOGY LIMITED, Grand Cayman (KY)

(72) Inventors: Chun-Yi Chang, New Taipei (TW); Terrance F. Little, Fullerton, CA (US); Paul Chen, Walnut, CA (US); Stephen Sedio, Valley Center, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/942,968

(22) Filed: Nov. 16, 2015

(65) Prior Publication Data

US 2016/0141819 A1 May 19, 2016

Related U.S. Application Data

(60) Provisional application No. 62/080,250, filed on Nov. 14, 2014.

(51) Int. Cl.

| | |
|---|---|
| ***H01R 13/60*** | (2006.01) |
| ***H01R 31/00*** | (2006.01) |
| *H01R 13/24* | (2006.01) |
| *H01R 13/426* | (2006.01) |
| *H01R 107/00* | (2006.01) |

(52) U.S. Cl.

CPC ..... *H01R 31/005* (2013.01); *H01R 13/2435* (2013.01); *H01R 13/426* (2013.01); *H01R 2107/00* (2013.01); *H01R 2201/12* (2013.01)

(58) Field of Classification Search

USPC ..... 439/65, 66, 529, 500, 71, 600, 626; 361/697

See application file for complete search history.

(56) References Cited

U.S. PATENT DOCUMENTS 5,259,769 A * 11/1993 Cruise ..... H01R 13/2442 439/65
D419,133 S * 1/2000 Yoshida ..... D13/120
6,315,576 B1 * 11/2001 Neidich ..... H01R 13/2435 439/591
6,746,281 B1 * 6/2004 Zhang ..... H01R 12/725 439/637

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulator adapted to be downwardly assembled into the housing of the cradle, and a set of contacts upwardly assembled into the insulator. Each contact includes a vertical retention section received in the corresponding retention slot in the insulator via an upward insertion process, and an upper spring arm extending from an upper edge of the retention section for mechanically and electrically connecting to the machine case, and a lower spring arm extending from a lower edge of the retention section for mechanically and electrically connecting to the cable. The free end of the upper spring arm is downwardly abutted against by the insulator while that of the lower spring arm is not.

18 Claims, 31 Drawing Sheets

(56) References Cited

U.S. PATENT DOCUMENTS 6,875,049 B2 * 4/2005 Kyowski ..... H01R 11/282 439/500
6,951,488 B2 * 10/2005 Hsieh ..... H01R 12/7011 439/500
6,991,496 B2 * 1/2006 Kuribayashi ..... H01R 13/6658 439/404
7,052,284 B2 * 5/2006 Liao ..... H01R 13/2435 439/66
7,108,554 B2 * 9/2006 Huang ..... H01R 23/6873 439/378
7,390,229 B2 * 6/2008 Huang ..... H01R 11/282 439/862
7,445,502 B2 * 11/2008 Zhang ..... H01R 13/6275 439/607.01
7,559,811 B1 * 7/2009 Polnyi ..... H01R 4/4809 439/591
7,597,576 B2 * 10/2009 Zhang ..... H01R 12/7029 439/299
7,625,254 B2 * 12/2009 Zhang ..... H01R 12/57 439/500
7,654,868 B1 * 2/2010 Wang ..... G06K 7/0021 439/630
7,791,443 B1 * 9/2010 Ju ..... H01R 12/52 336/107
7,803,011 B1 * 9/2010 Mai ..... H01R 13/2428 439/500
7,922,547 B2 * 4/2011 Wu ..... H01R 13/2442 439/862
7,972,144 B2 * 7/2011 Chang ..... H01R 4/02 439/66
7,988,501 B2 * 8/2011 Chang ..... H05K 7/1069 439/751
8,282,431 B1 * 10/2012 Zhang ..... H01R 12/714 439/591
8,323,038 B2 * 12/2012 Jin ..... H01R 12/714 439/66
8,523,615 B2 * 9/2013 Luo ..... H01R 12/7082 439/660
8,647,153 B2 * 2/2014 Ju ..... H01R 12/714 439/626
8,708,716 B1 * 4/2014 Ho ..... H01R 12/57 439/83
8,821,188 B2 * 9/2014 Chang ..... H01R 13/6586 439/607.01
8,858,238 B2 * 10/2014 Luo ..... H01R 12/7082 439/66
9,099,819 B2 * 8/2015 Hwang ..... H01R 12/7082
2003/0124879 A1 * 7/2003 Ng ..... H01R 12/714 439/66
2010/0184334 A1 * 7/2010 Ma ..... H01R 13/2442 439/626
2012/0225586 A1 * 9/2012 Tsai ..... H01R 13/2442 439/626
2012/0296174 A1 * 11/2012 McCombie ..... A61B 5/02427 600/301
2014/0038438 A1 * 2/2014 Chang ..... H01R 12/71 439/76.1
2014/0080327 A1 * 3/2014 Hwang ..... H01R 13/6585 439/65
2014/0349518 A1 * 11/2014 Chang ..... H01R 13/6585 439/607.01
2015/0099376 A1 * 4/2015 Hashiguchi ..... H01R 12/714 439/66
2015/0171648 A1 * 6/2015 Williams ..... H01R 13/7175 320/107

* cited by examiner

ELECTRICAL CONNECTOR FOR USE WITH CRADLE

This application claims the benefit of, and priority to U.S. Provisional Patent Application No. 62/080,250, filed Nov. 14, 2014, the contents of which are incorporated entirely herein by reference.

BACKGROUND OF THE INVENTION

1. Field of the Invention

The invention relates to the electrical connector for use within a cradle which connects the machine case and a plurality of cables. The instant application related to a copending application titled "MACHINE CASE WITH IMPROVED ELECTRICAL CONNECTOR" with the same applicant and some common inventors, and another copending application titled "MACHINE CASE WITH IMPROVED TERMINAL MODULE" with the same applicant and some common inventors.

2. Description of Related Art

Wearable medical technology is becoming a hot commodity, as these devices come to market; they have the potential to help both patients and clinicians monitor vital signs and symptoms. The wearable medical device usually comprises a cradle, a machine case attached to the cradle for housing processing module such as processor and associated electronics, and cables with plugs inserted into the cradle. During use, the machine case reversibly snaps into the cradle, upon mating of the cradle and the machine case, interface cavities are formed on the cradle for receiving the plugs of the cables leading to one or more peripheral devices such as sensors which collect data related to the physiological properties of interest, such as heart rate, temperature, SpO2, blood pressure, etc., therefore, the data related to the physiological properties could be presented on the machine case for patients or clinicians monitoring. Thereby, the cradle serving as a carrier must provide a reliable electrical communication between the machine case and the cables. Notably, the instant invention is to make an improvement to the cradle, as shown in US patent publication no. 2012/0296174, regarding the corresponding connectors.

An electrical connector for use within the cradle is designed to improve those disclosed in the aforementioned proposal.

SUMMARY OF THE INVENTION

According to one aspect of the present invention, an electrical connector for use within a cradle which is adapted to receive a machine case and connects a plurality of cables so as to establish electrical connection between the machine case and the cables. The electrical connector includes an insulator adapted to be downwardly assembled into the housing of the cradle, and a plurality of contacts upwardly assembled into the insulator. Each contact includes a vertical retention section received in the corresponding retention slot in the insulator via an upward insertion process, and an upper spring arm extending from an upper edge of the retention section for mechanically and electrically connecting to the machine case, and a lower spring arm extending from a lower edge of the retention section for mechanically and electrically connecting to the cable. The free end of the upper spring arm is downwardly abutted against by the insulator while that of the lower spring arm is not. The insulator defines a plurality of narrowed passageways in alignment with the corresponding retention slot to regulate up-and-down movement of the corresponding upper spring arm and lower sprint arm.

According to another aspect of the present invention, an electrical connector for use within a cradle includes an insulator and a plurality of contacts retained in the insulator. The insulator defines opposite top and bottom surfaces thereon in a vertical direction, and a set of retention slots arranged at intervals in a longitudinal direction perpendicular to the vertical direction. Each of said contacts includes a retention section retainably received in the corresponding retention slot, and opposite upper and lower spring arms extending along a transverse direction and protruding upwardly and downwardly beyond said top and bottom surfaces of the insulator respectively. The retention section includes an unexposed part hidden within the retention slot, and an exposed part beside the unexposed part in the longitudinal direction and transversely exposed out of the retention slot. The insulator defines a stopper at upper side of the retention slot and downwardly abutting against the unexposed part. The upper and lower spring arms extend from respective upper and lower edges of the exposed part.

Other objects, advantages and novel features of the invention will become more apparent from the following detailed description when taken in conjunction with the accompanying drawings.

BRIEF DESCRIPTION OF THE DRAWINGS

FIG. 2(A)-1 is a cross-sectional view of the cradle and the associated cables of FIG. 2(A).

DETAILED DESCRIPTION OF THE PREFERRED EMBODIMENT

Figure 1:
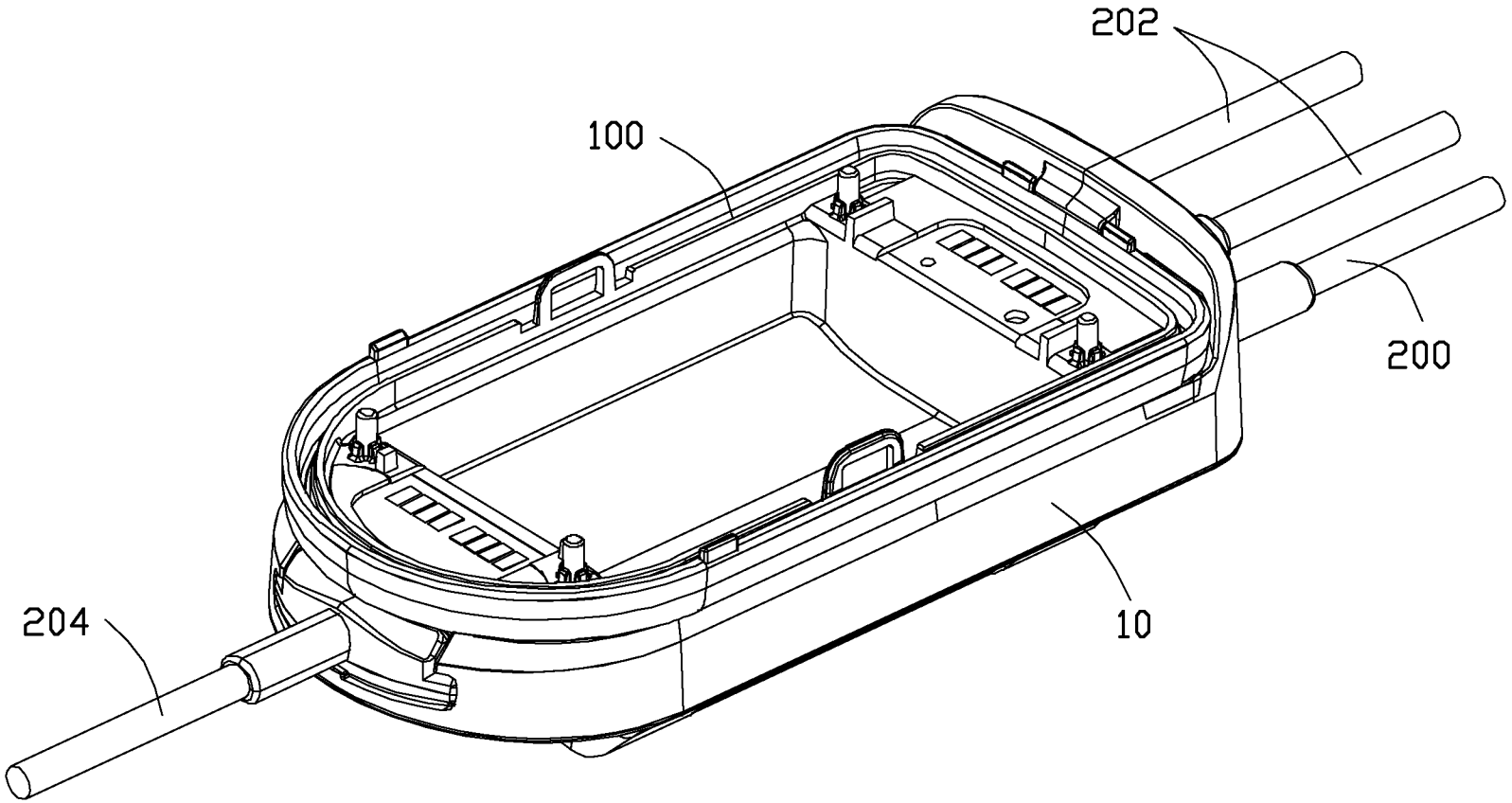
FIG. 1 is an assembled perspective view of the cradle connecting both the machine case and the cables according to one embodiment of the invention.
Figure 2A:
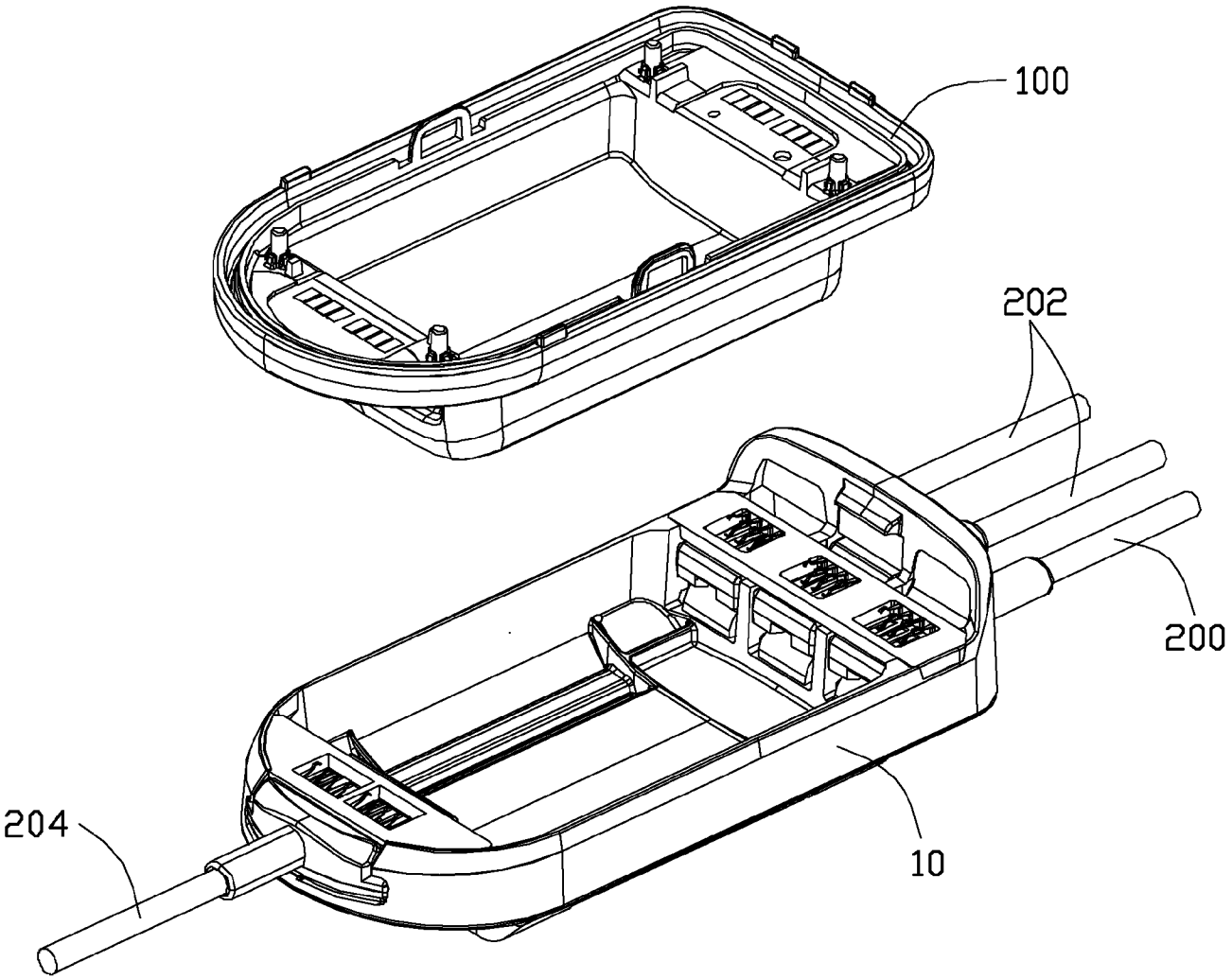
FIG. 2(A) is a downward exploded perspective view of the cradle of FIG. 1 with the machine case being taken away while the cables still linked.
Figures 1, 2A:
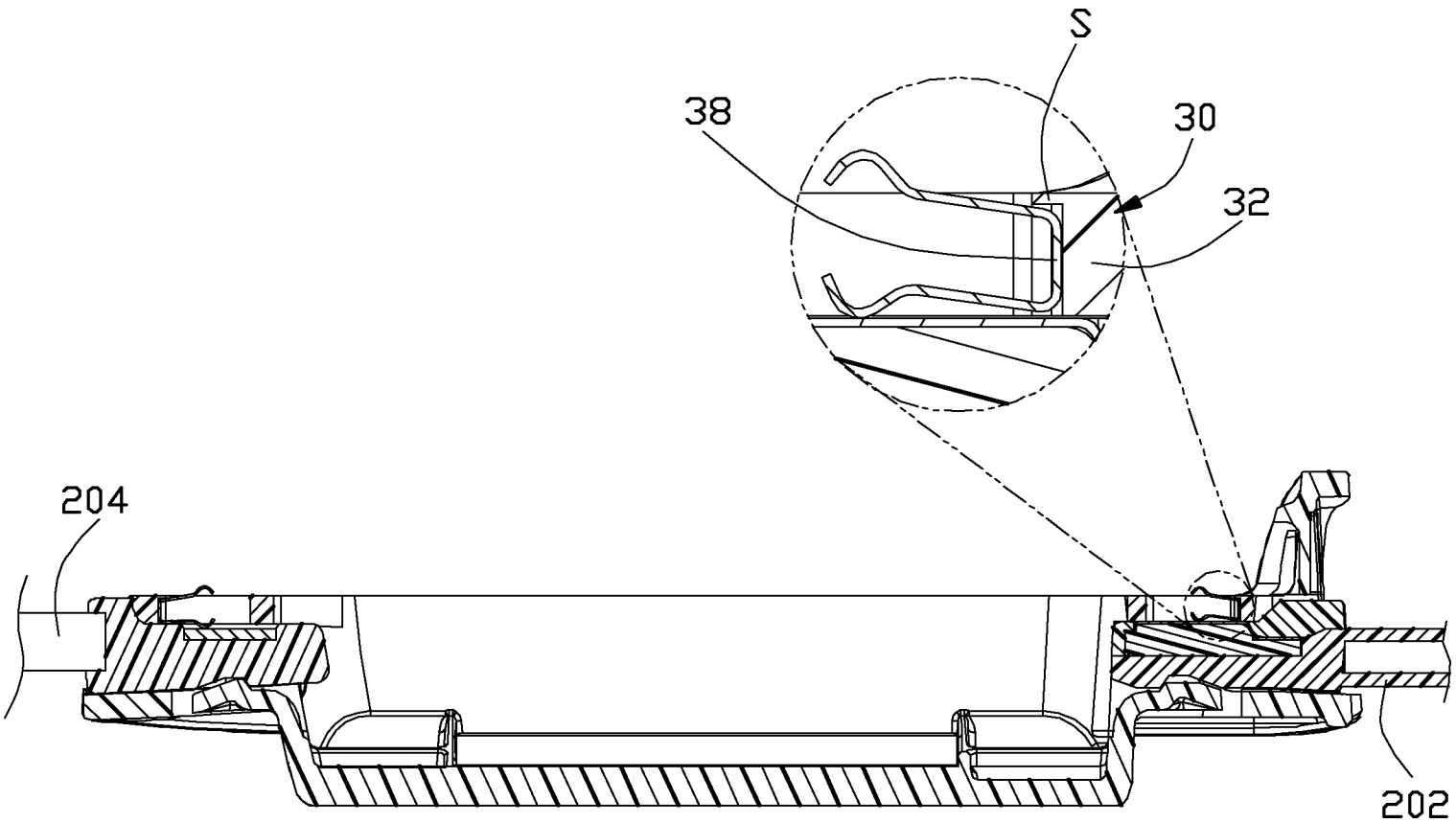
Figure 2B:
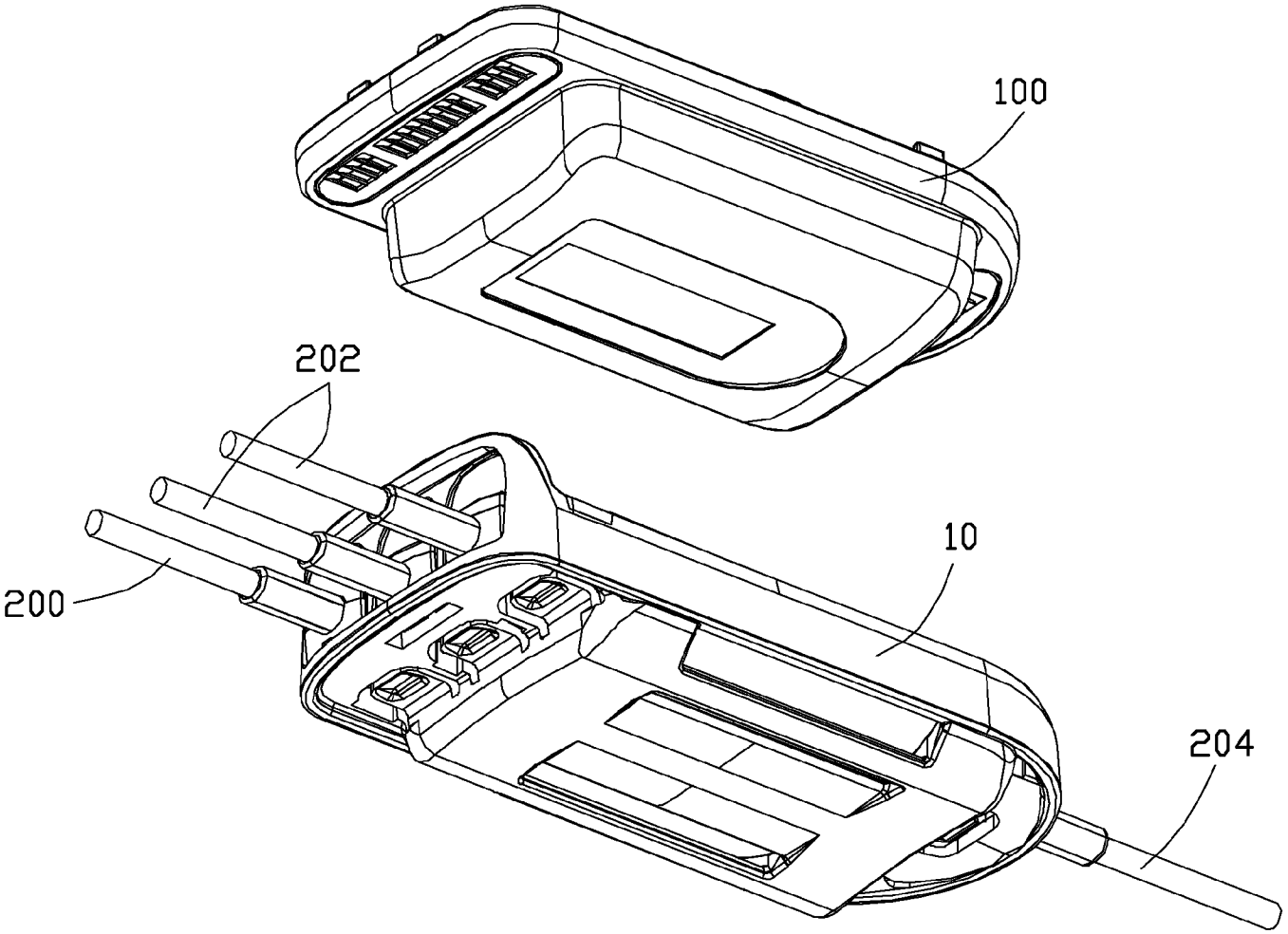
FIG. 2(B) is an upward exploded perspective view of the cradle of FIG. 2(A).
Figure 3A:
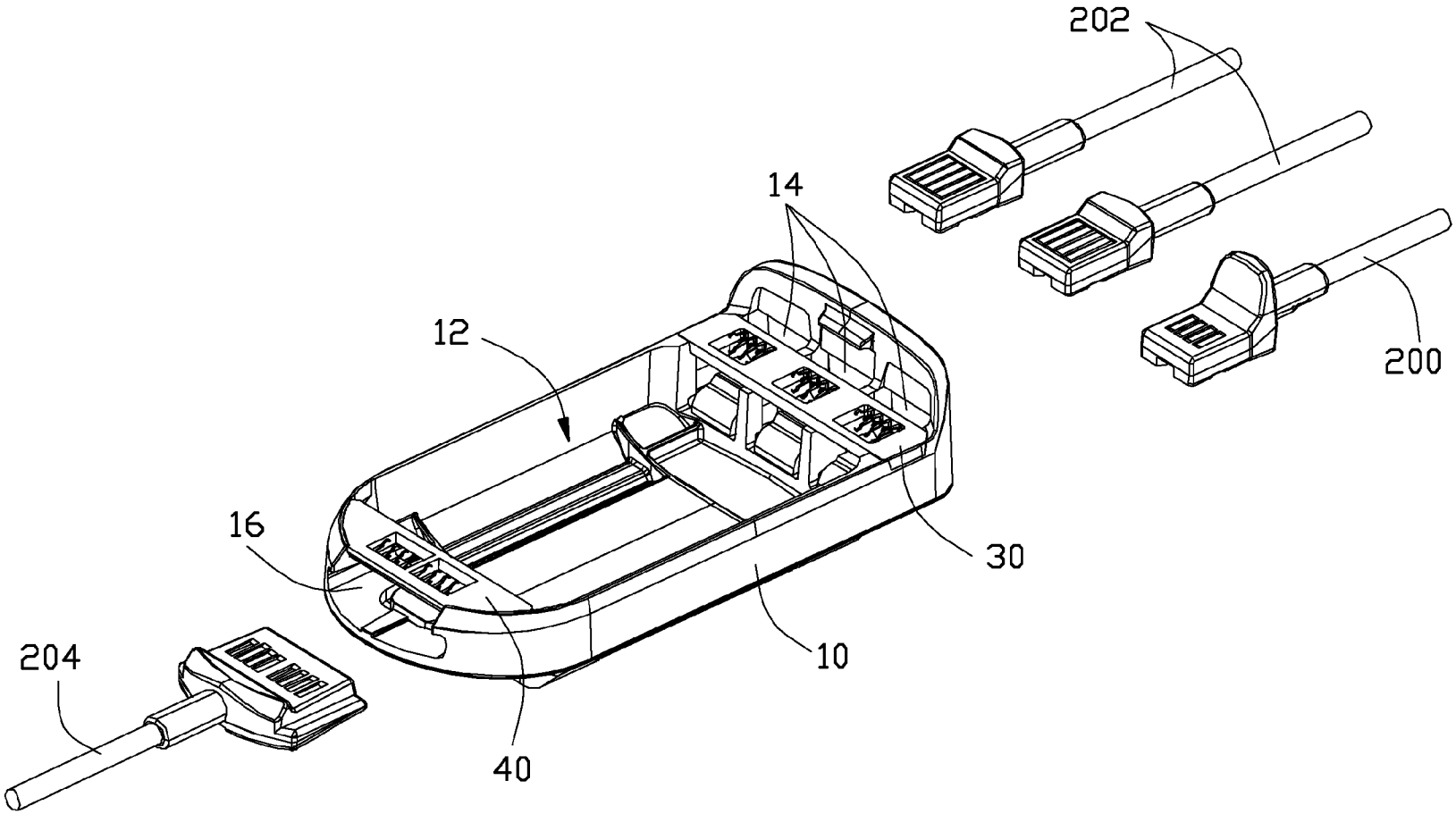
FIG. 3(A) is a downward perspective view of the cradle of FIG. 2(A) with the cables being taken away.
Figure 3B:
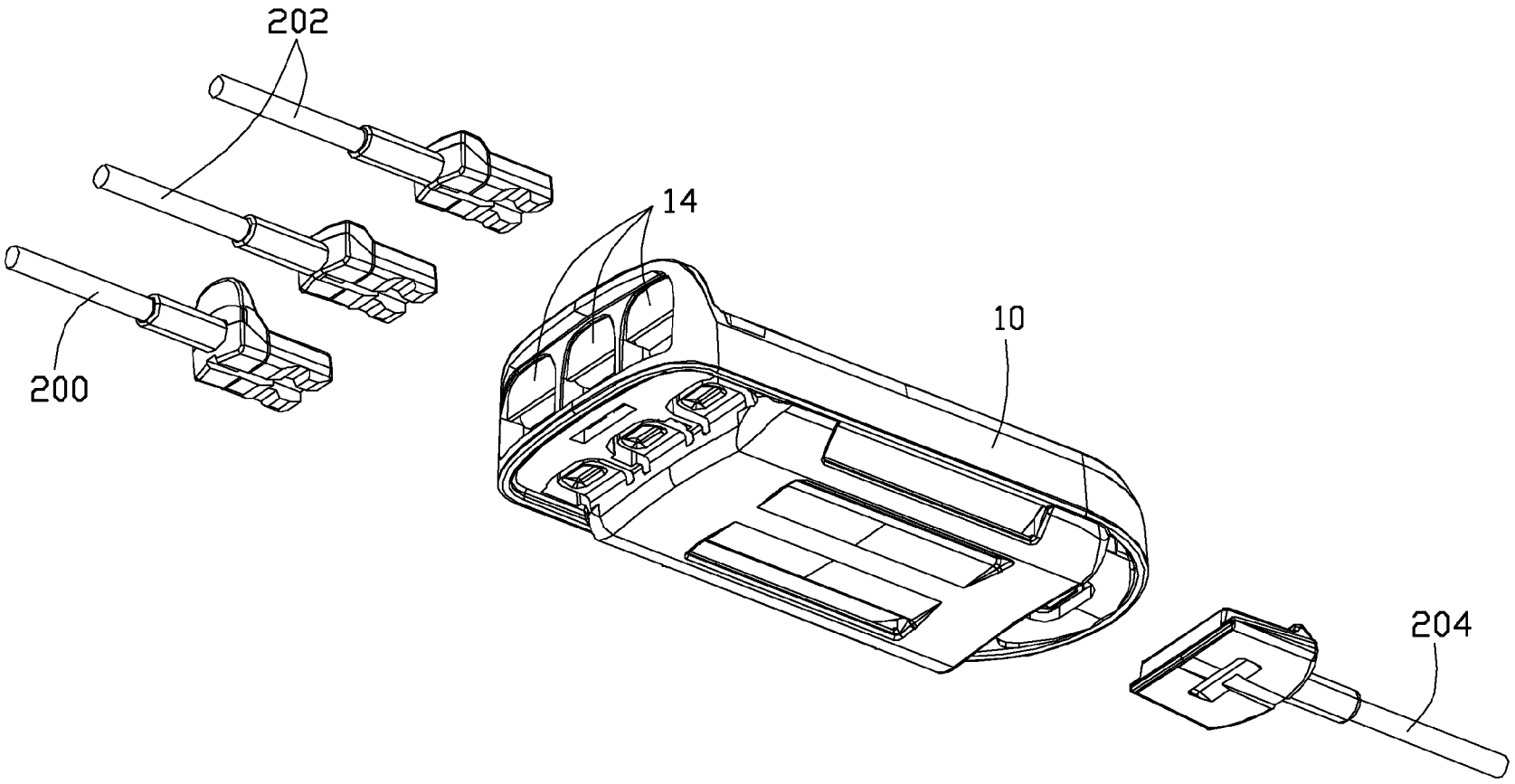
FIG. 3(B) is an upward exploded perspective view of the cradle of FIG. 3(A).
Figure 4A:
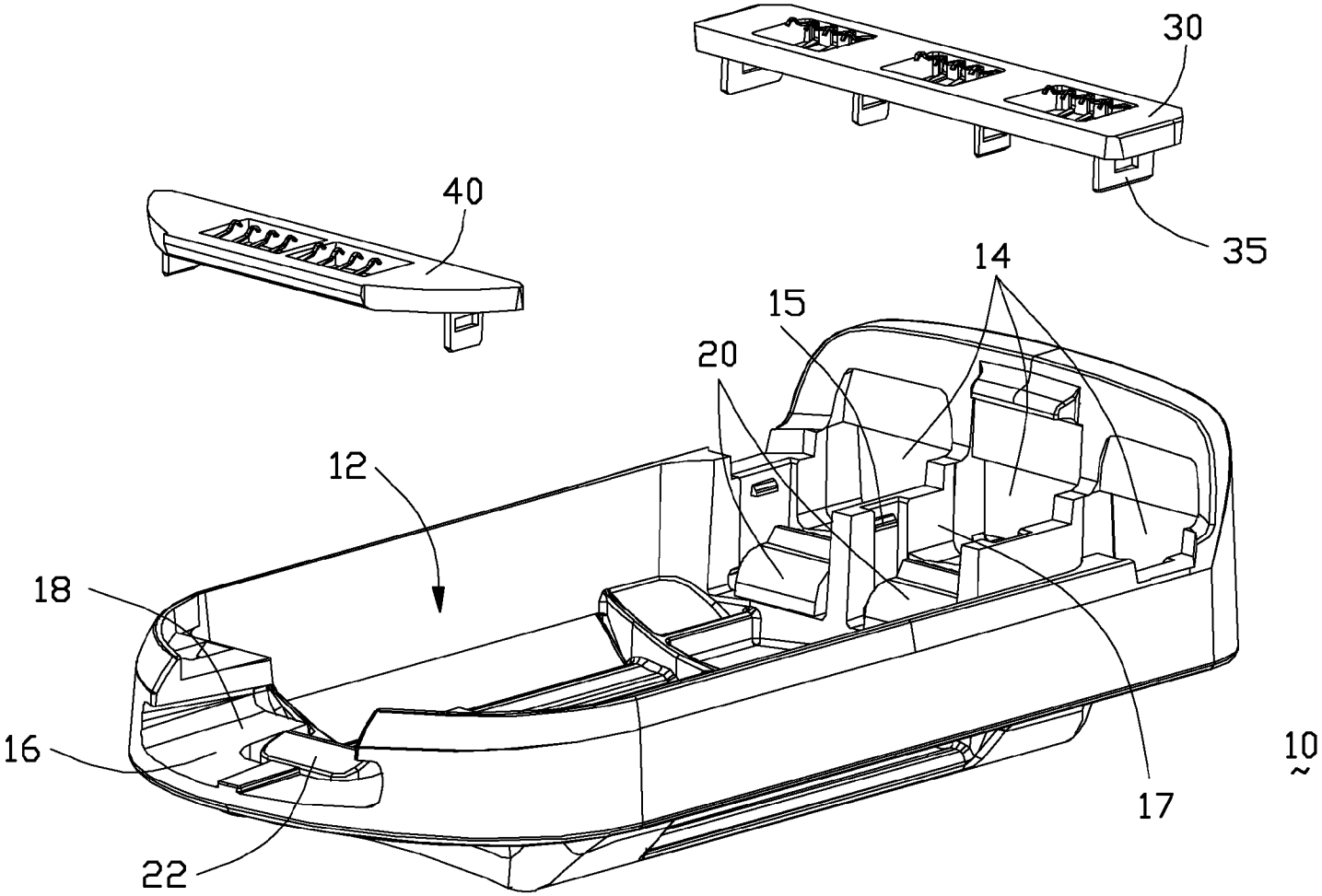
FIG. 4(A) is a downward exploded perspective view of the cradle of FIG. 3(A) with the terminal modules being taken away.
Figure 4B:
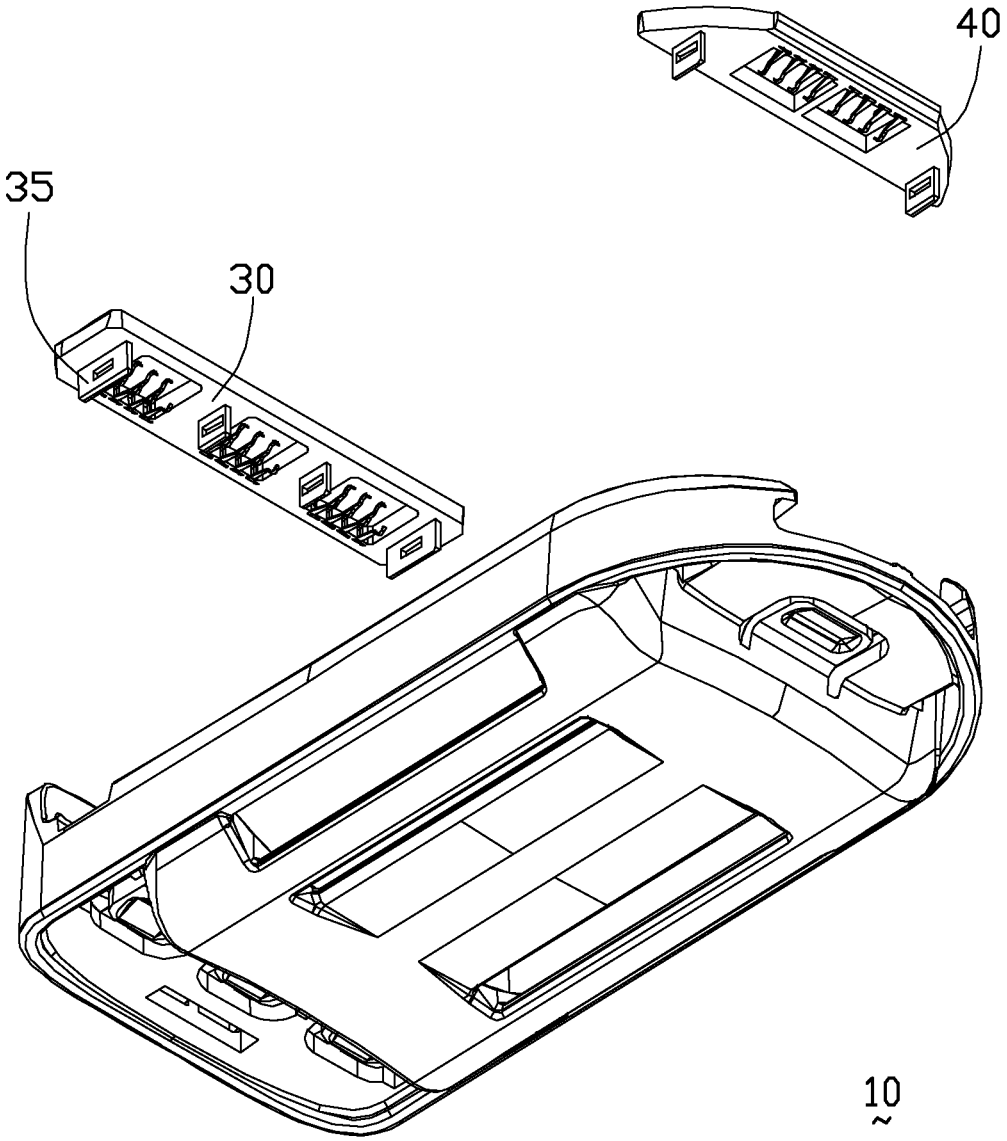
FIG. 4(B) is an upward exploded perspective view of the cradle of FIG. 4(A).

Reference will now be made in detail to the preferred embodiment of the present invention. FIGS. 1-3(B) show a cradle 10 connecting a machine case 100 and a plurality of cables 200, 202, 204. Further referring to FIGS. 4(A)-5, the cradle 10 forms a receiving cavity 12 to receive the machine case 100 therein. The two opposite deck stations (not labeled) are formed at two opposite ends of the receiving cavity 12. Three small openings 14 are formed in one end under a deck station (not labeled), and a large opening 16 is formed in the other end under another deck station (not labeled), into which the cables 200, 202 and 204 with the corresponding plug connectors, are inserted into the corresponding small cavities 17, 18 in the cradle 10. Three resilient latches 20 are located under the corresponding cavities 17 corresponding to the small openings 14 for latching the cables 200 and 202, and another resilient latch 22 is located under the corresponding cavity 18 corresponding to the large opening 16 for latching the cable 204. A larger terminal module 30 adapted to be downwardly assembled to the housing of the cradle 10, includes an insulator 32 and a plurality of contacts 34 retained thereon. The insulator 32 includes three openings 36. The contact 34 includes a retention section 38 upwardly inserted into the corresponding retention slot 31 and an upper spring arm 37 extending from the upper end of the retention section 38 into an upper side of the opening 36, and a lower spring arm 39 extending from a lower end of the retention section 38 into a lower side of the opening 36. Referring to FIG. 2(A)-1, a portion of the retention slot 31 does not extend through the top surface of the insulator 32 so as to form a stopper structure S to prevent excessive upward installation of the contact 34 into the insulator 32. The insulator 32 downwardly covers the cavities 17 and further includes a plurality of locking lugs 35 latching to the corresponding retention protrusions 15 formed in the cavities 17 of the cradle 10 so as to secure the terminal module 30 into the cradle 10 in position. Similarly, a small terminal module 40, which may be downwardly assembled to the housing of the cradle 10, includes an insulator 42 and a plurality of contacts 44 retained thereto in the same way.

Figure 9:
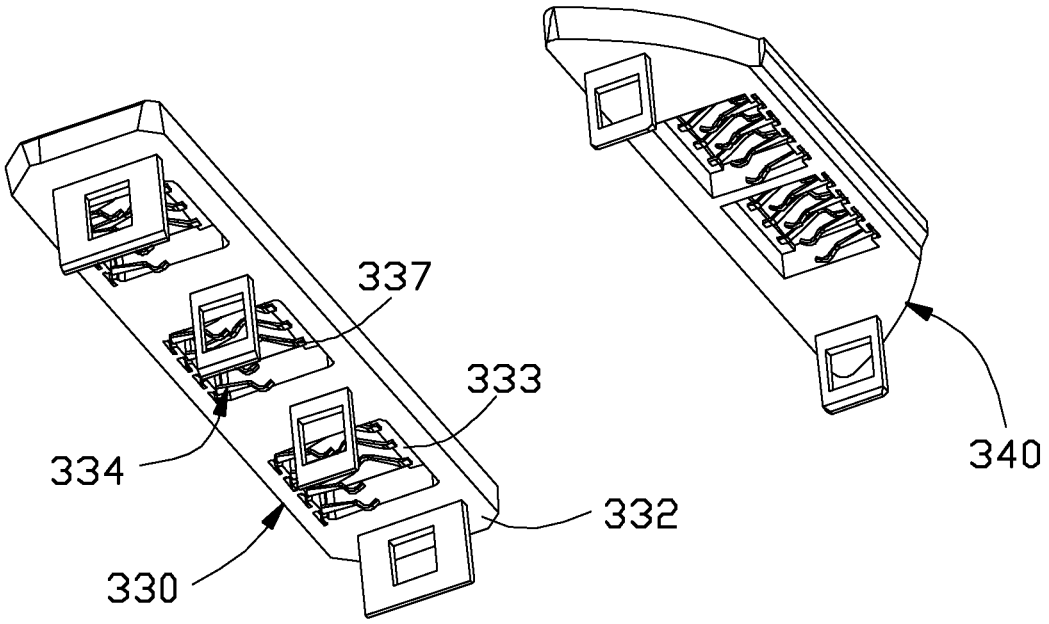
FIG. 9 is an upward perspective view of the terminal modules of FIG. 7.
Figure 9A:
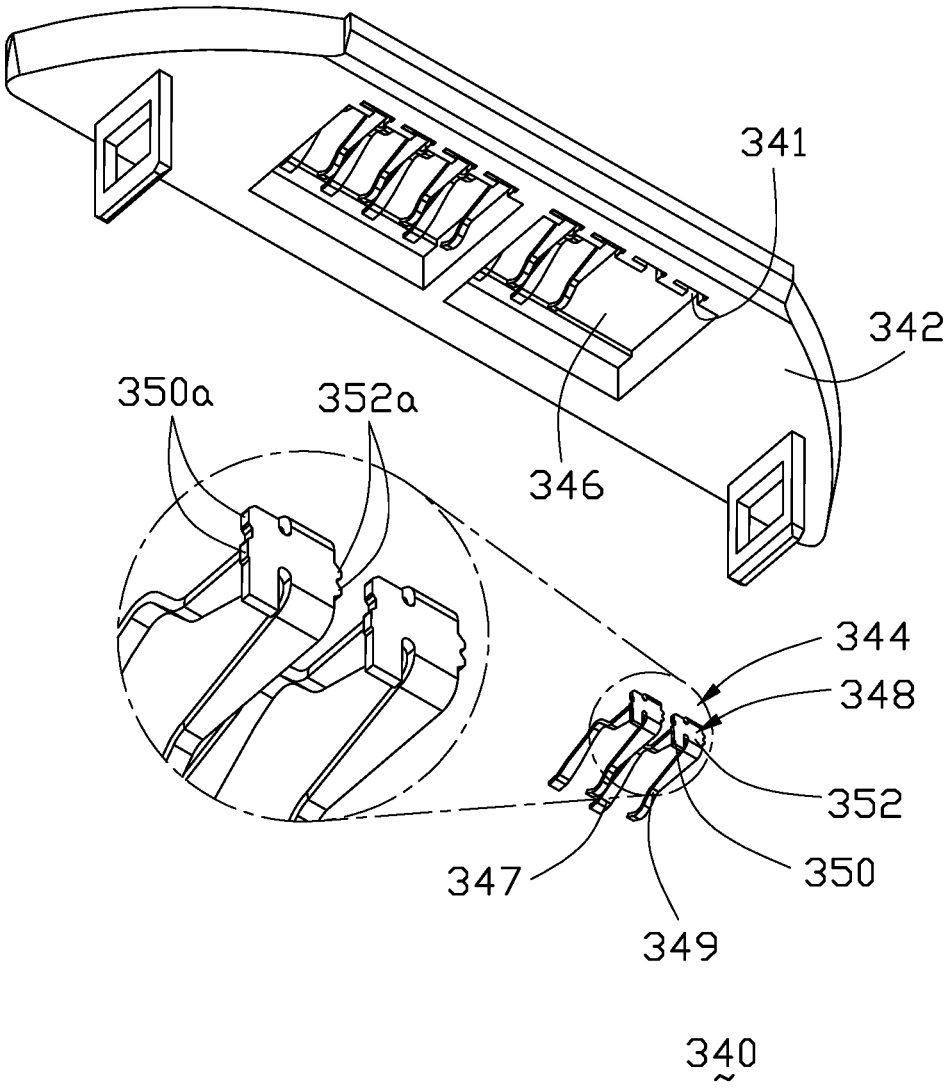
FIG. 9(A) is an upward perspective view of the terminal module of FIG. 9 with some contacts being disassembled from the insulator.
Figure 10A:
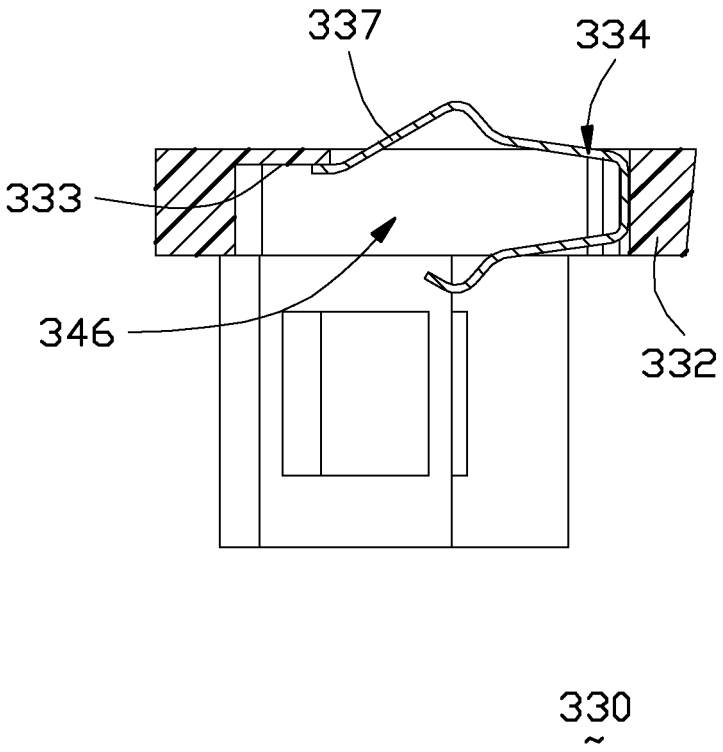
FIG. 10(A) is a cross-sectional view of the terminal module of FIG. 9.
Figure 10B:
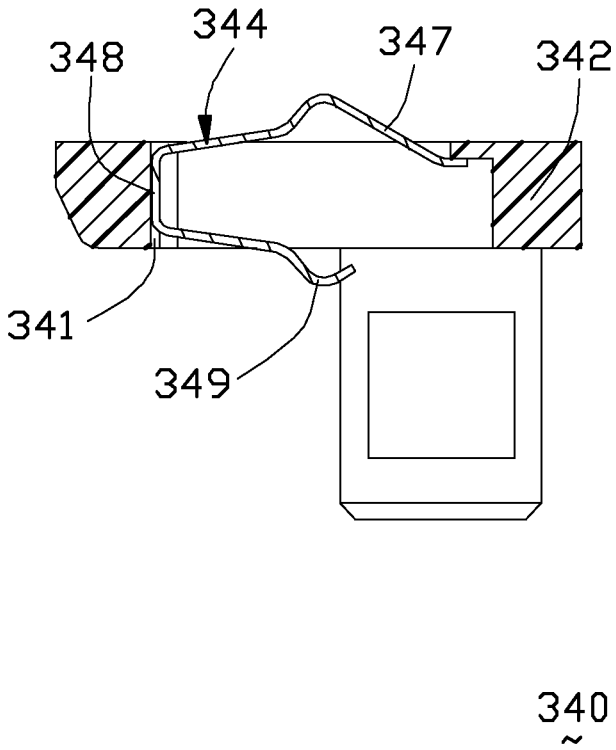
FIG. 10(B) is a cross-sectional view of the terminal module of FIG. 9(A).
Figure 11A:
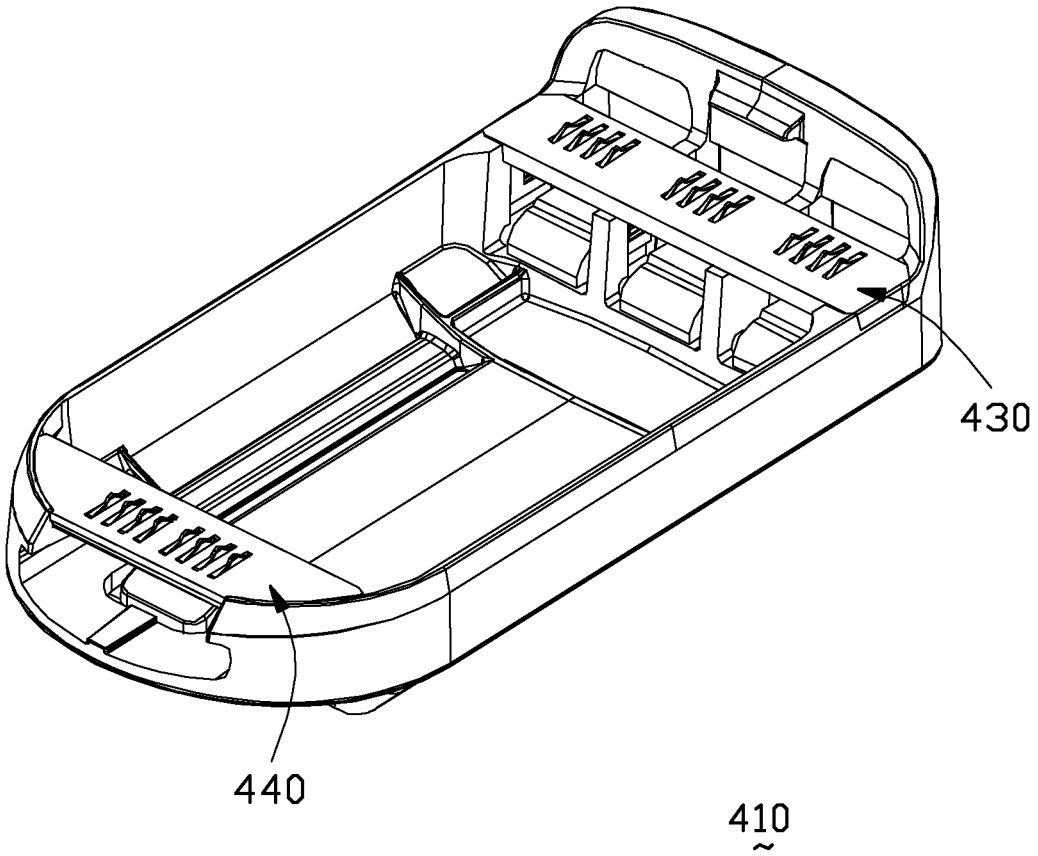
FIG. 11(A) is a downward perspective view of another embodiment of the cradle.
Figure 11B:
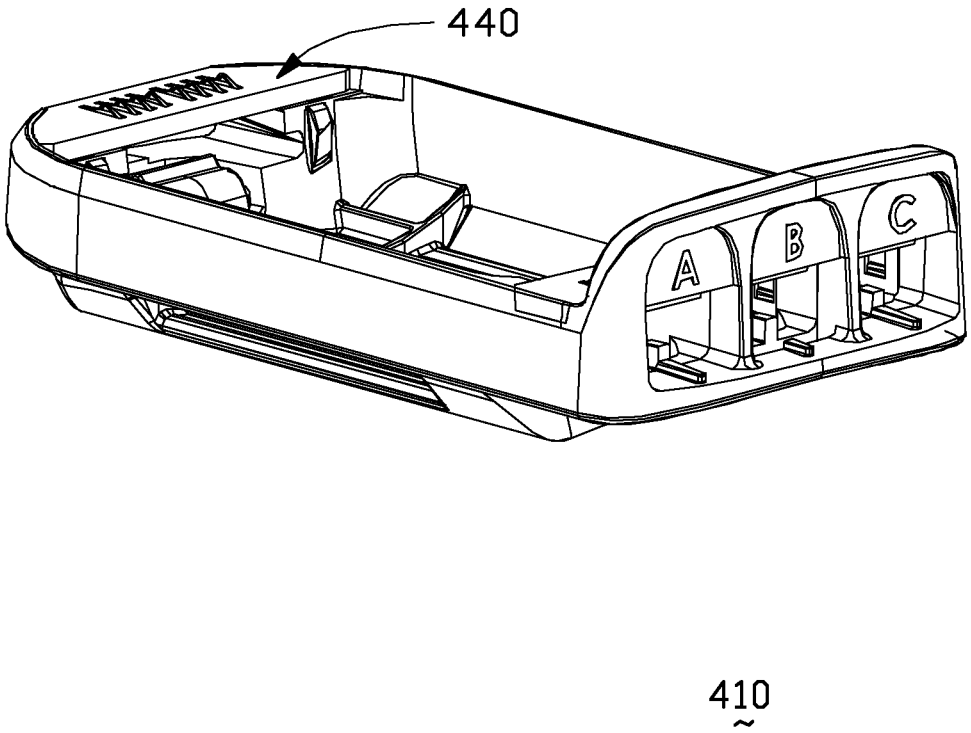
FIG. 11(B) is another downward perspective view of the cradle of FIG. 11(A).
Figure 12A:
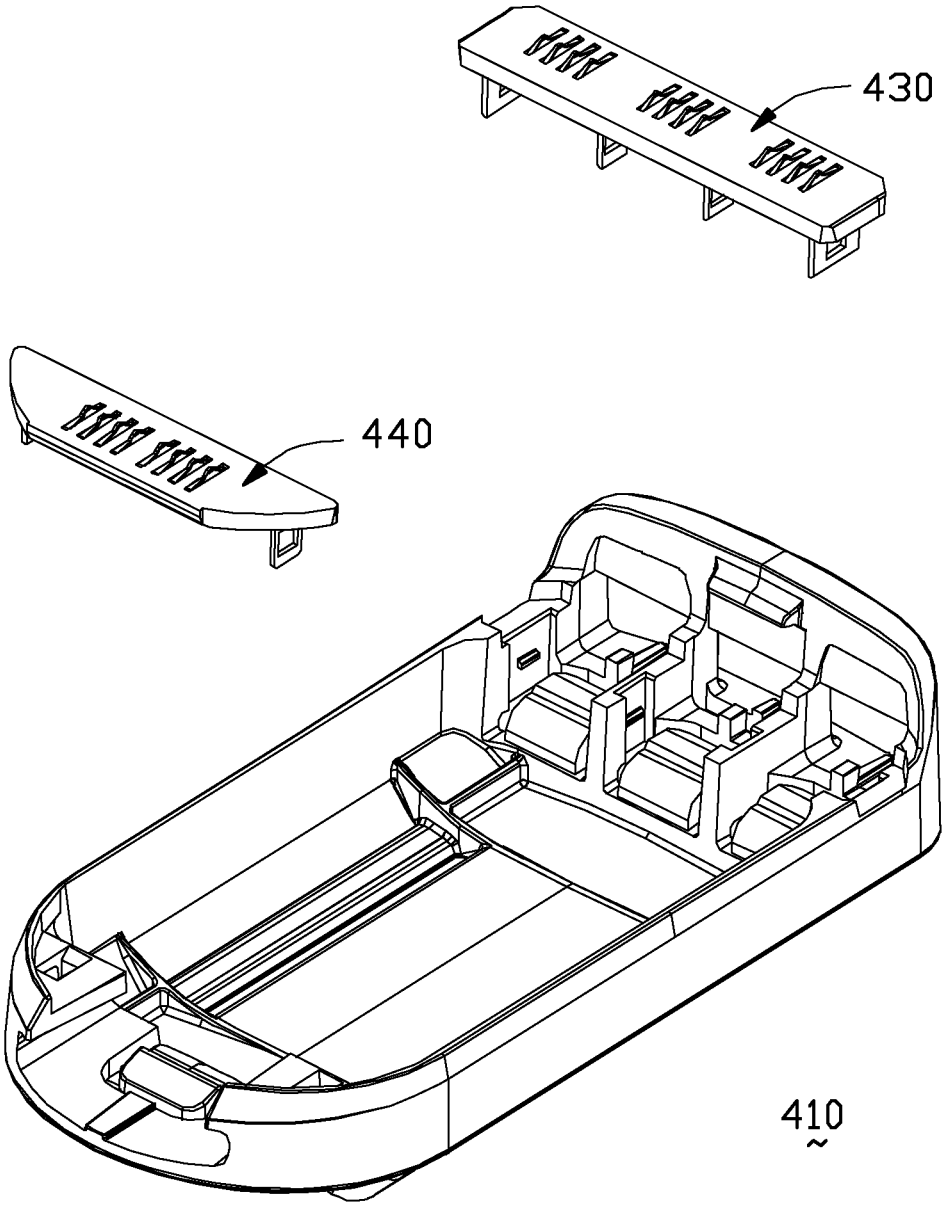
FIG. 12(A) is a downward exploded perspective view of the cradle of FIG. 11(A) with the terminal modules disassembled therefrom.
Figure 12B:
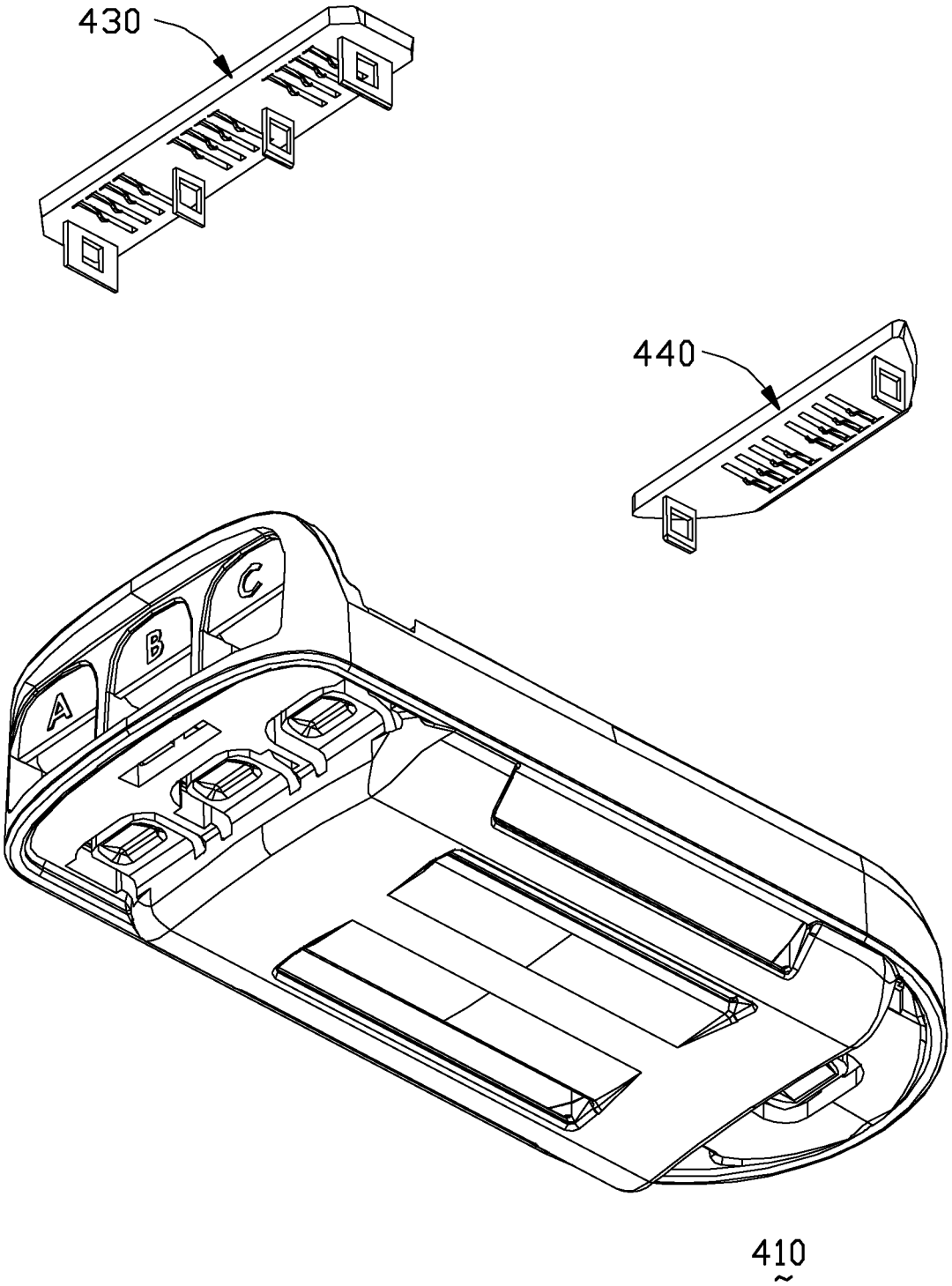
FIG. 12(B) is an upward exploded perspective view of the cradle of FIG. 11(A).
Figure 13A:
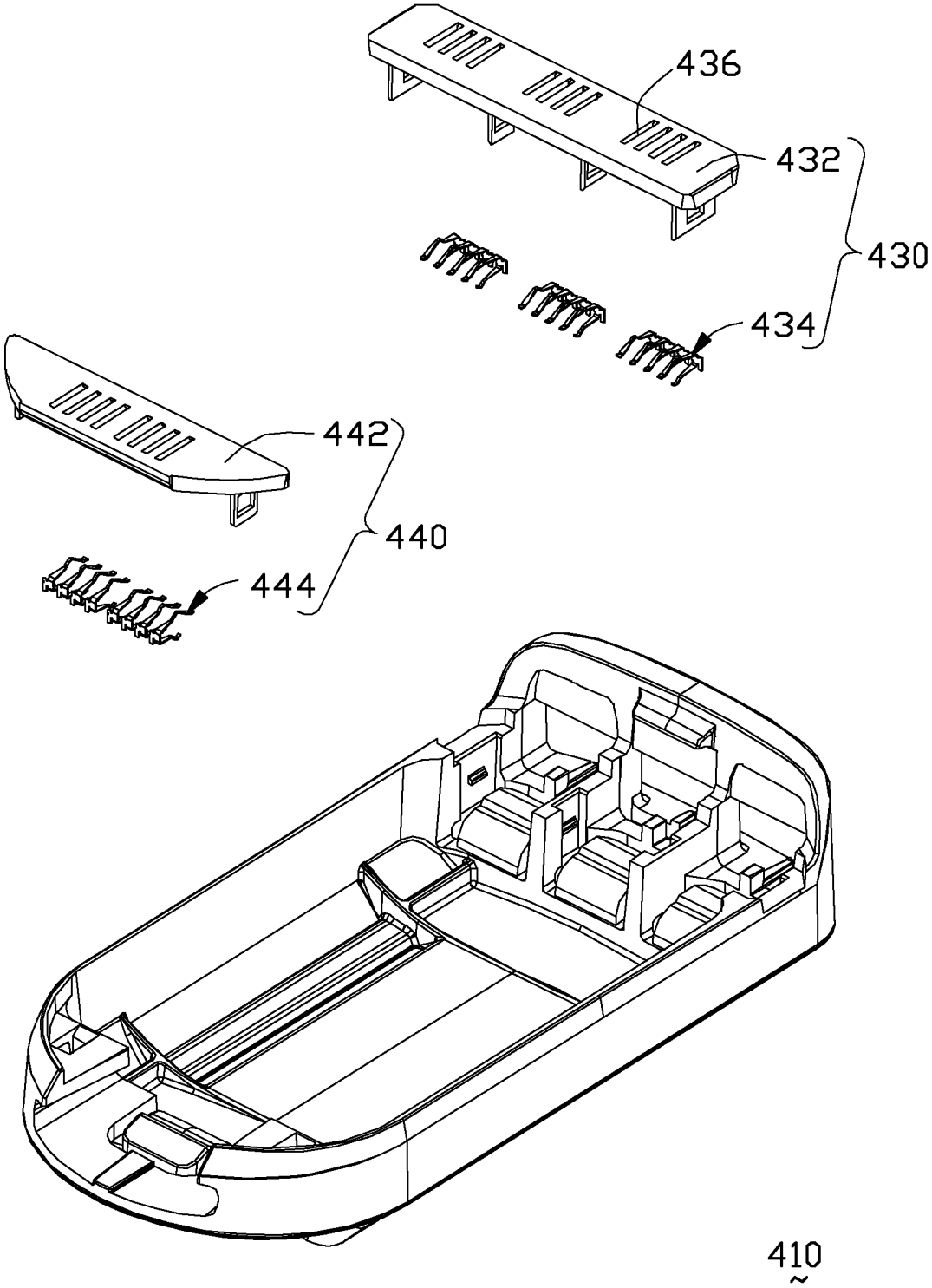
FIG. 13(A) is a downward exploded perspective view of the cradle of FIG. 12(A) with the contacts disassembled from the terminal modules.
Figure 13B:
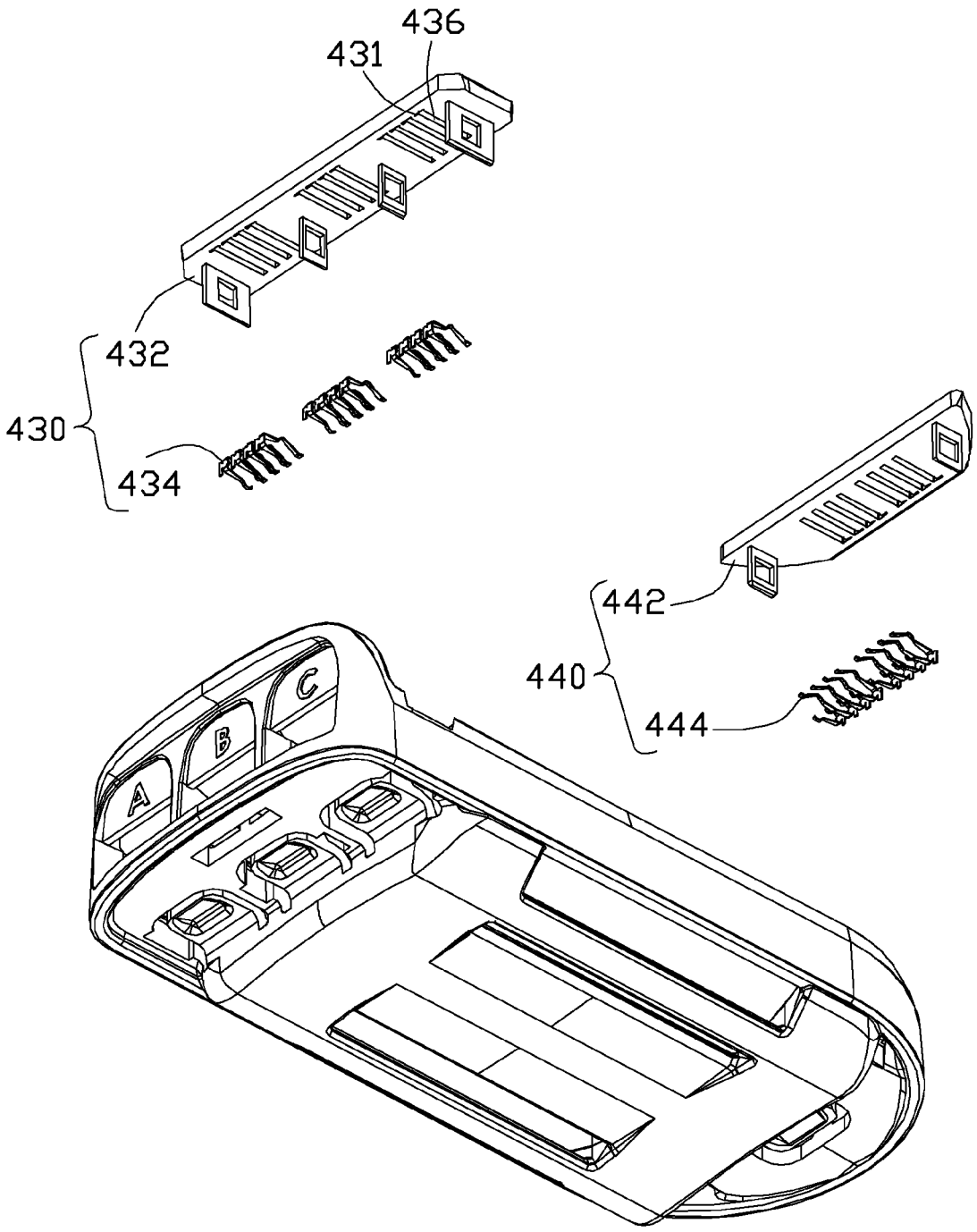
FIG. 13(B) is an upward exploded perspective view of the cradle of FIG. 13(A).
Figure 14A:
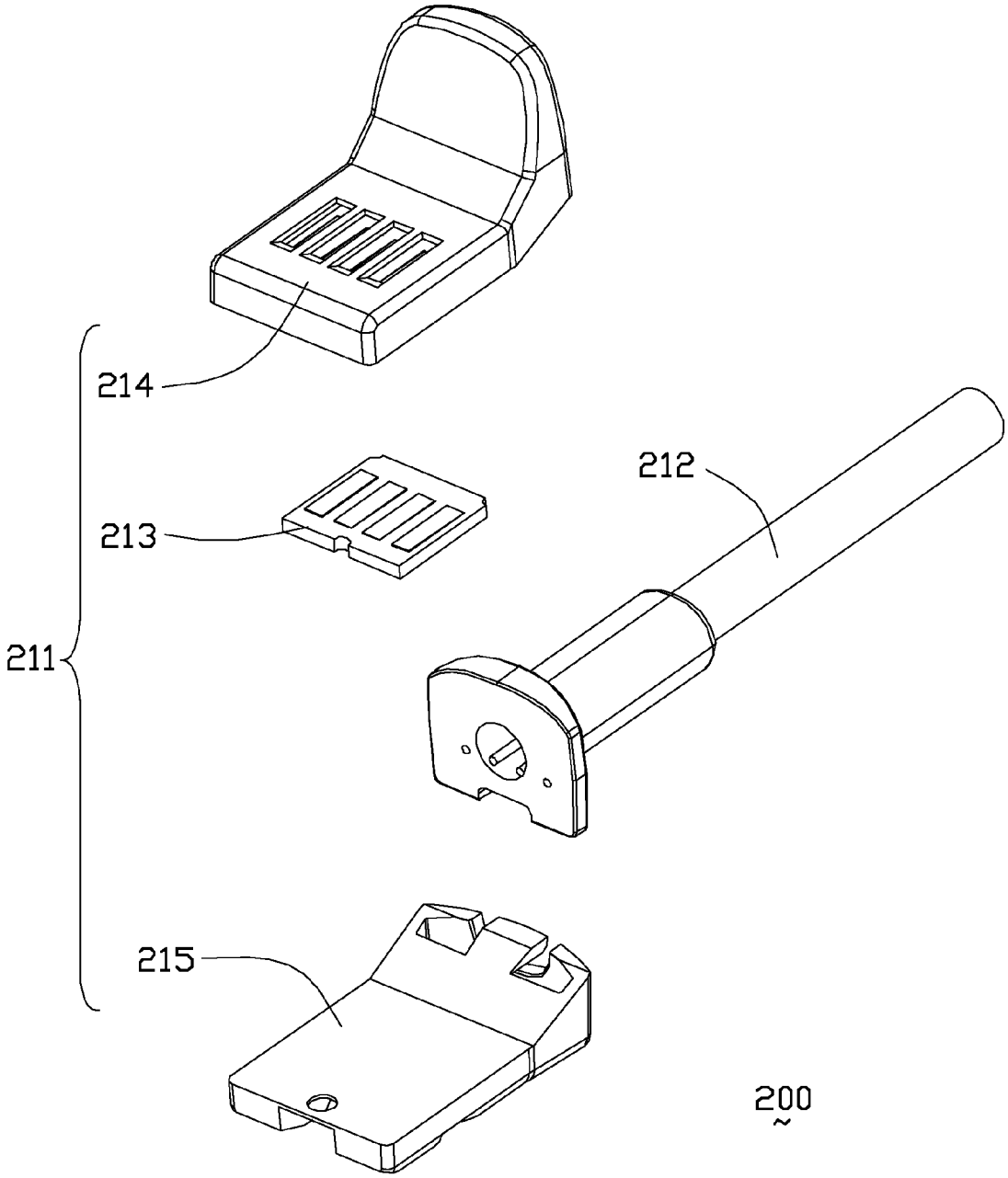
FIG. 14(A) is a downward exploded perspective view of one cable of FIG. 1
Figure 14B:
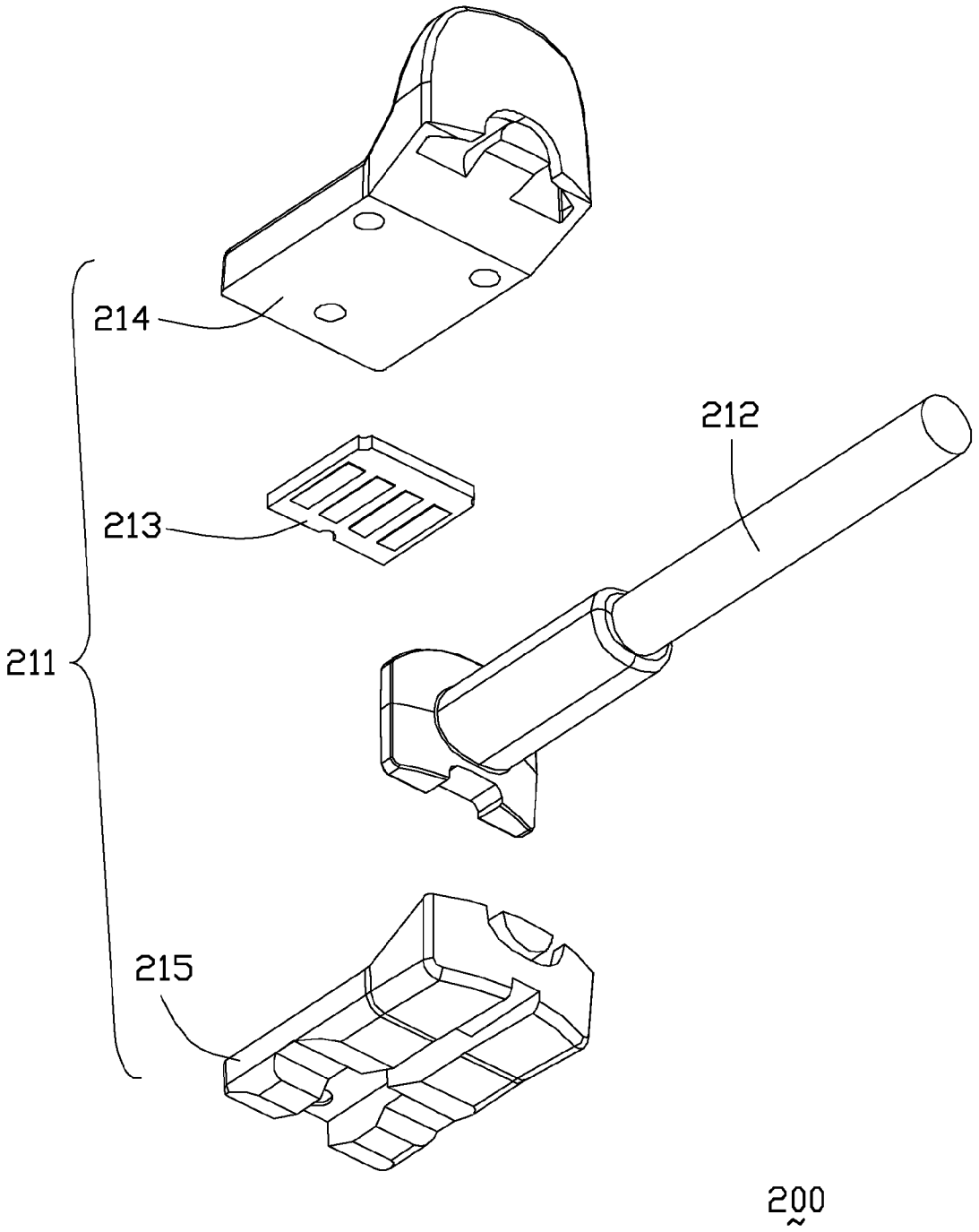
FIG. 14(B) is an upward exploded perspective view of the cable of FIG. 14(A).
Figure 15A:
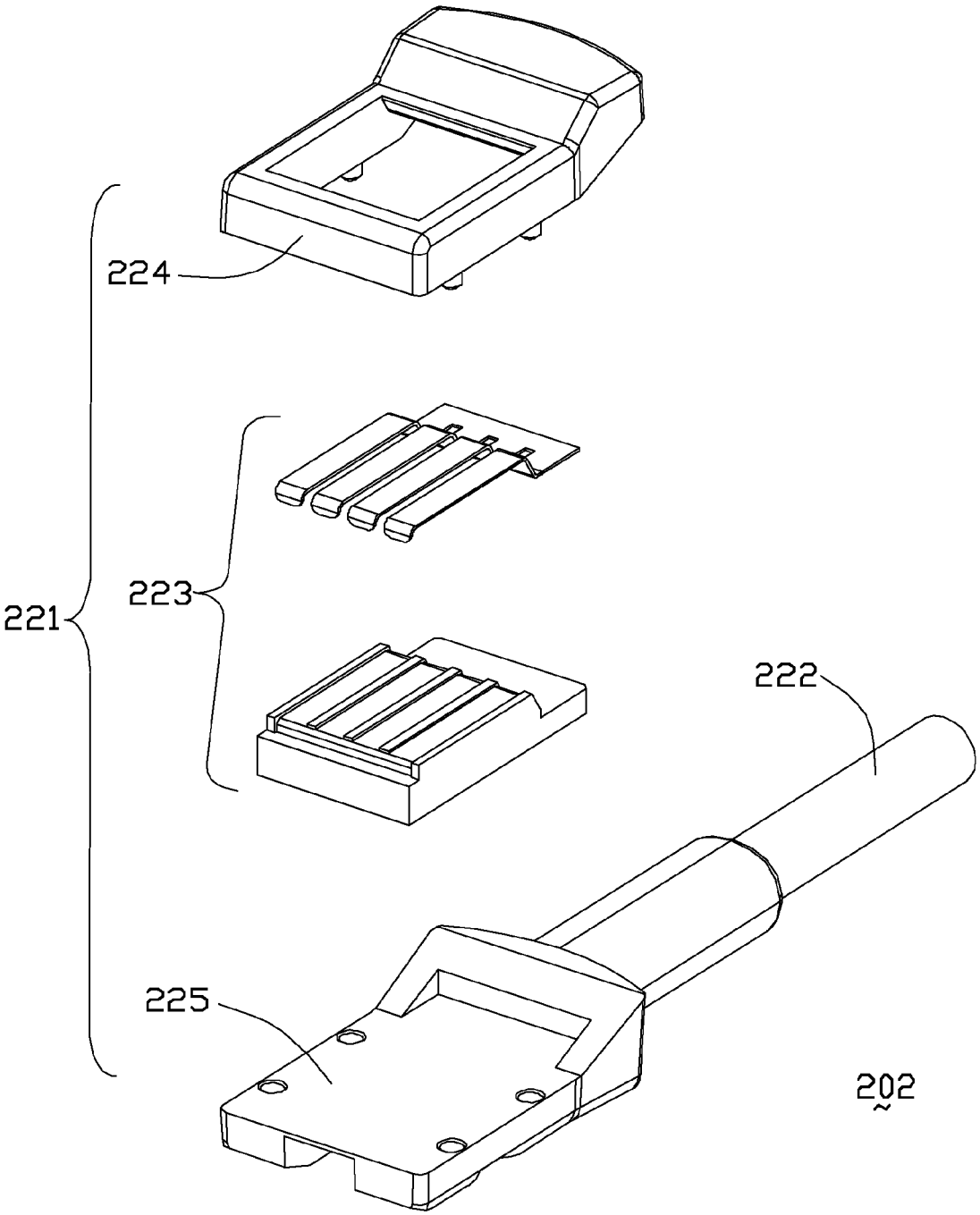
FIG. 15(A) is a downward exploded perspective view of another cable of FIG. 1
Figure 15B:
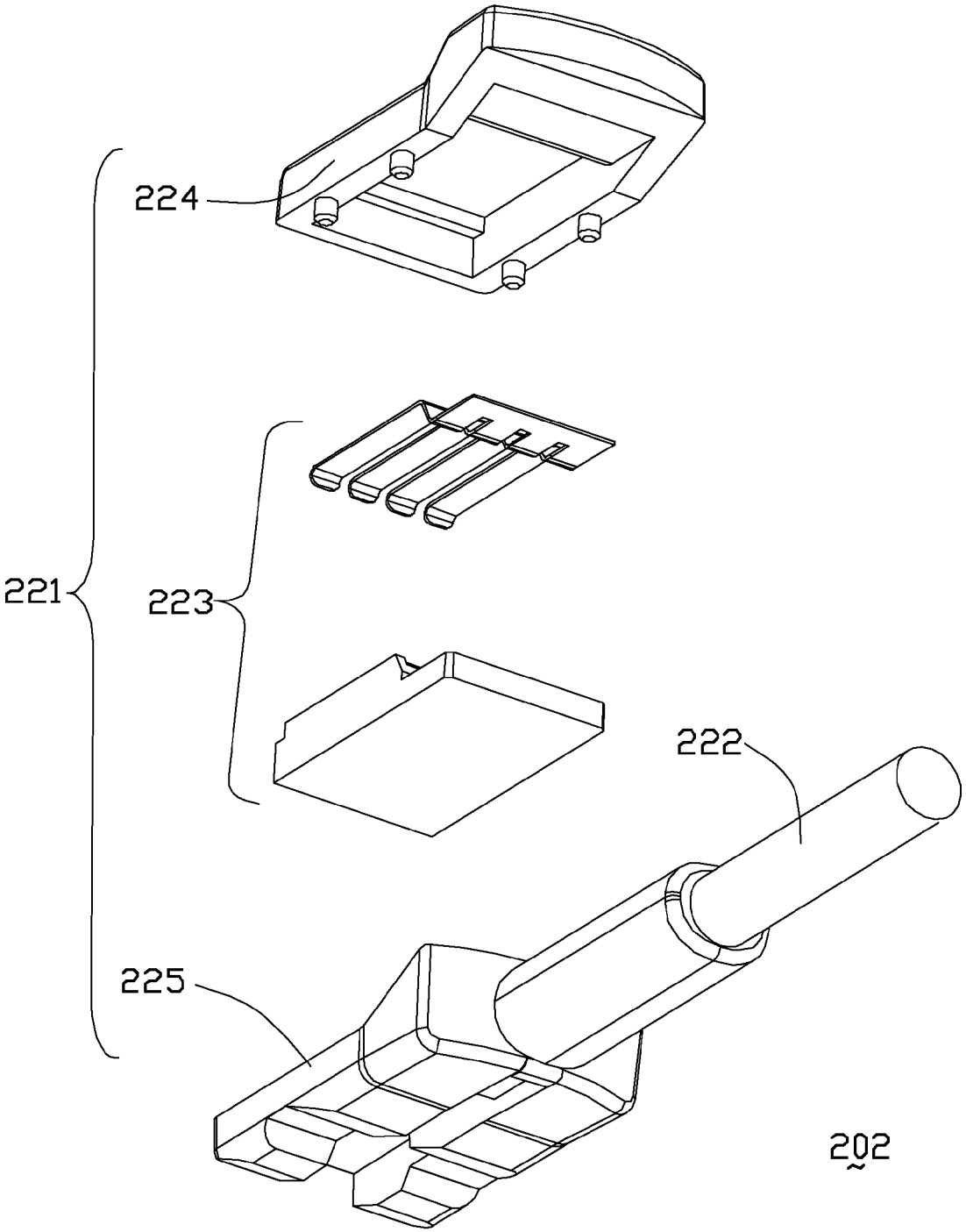
FIG. 15(B) is an upward exploded perspective view of the cable of FIG. 15(A).
Figure 16:
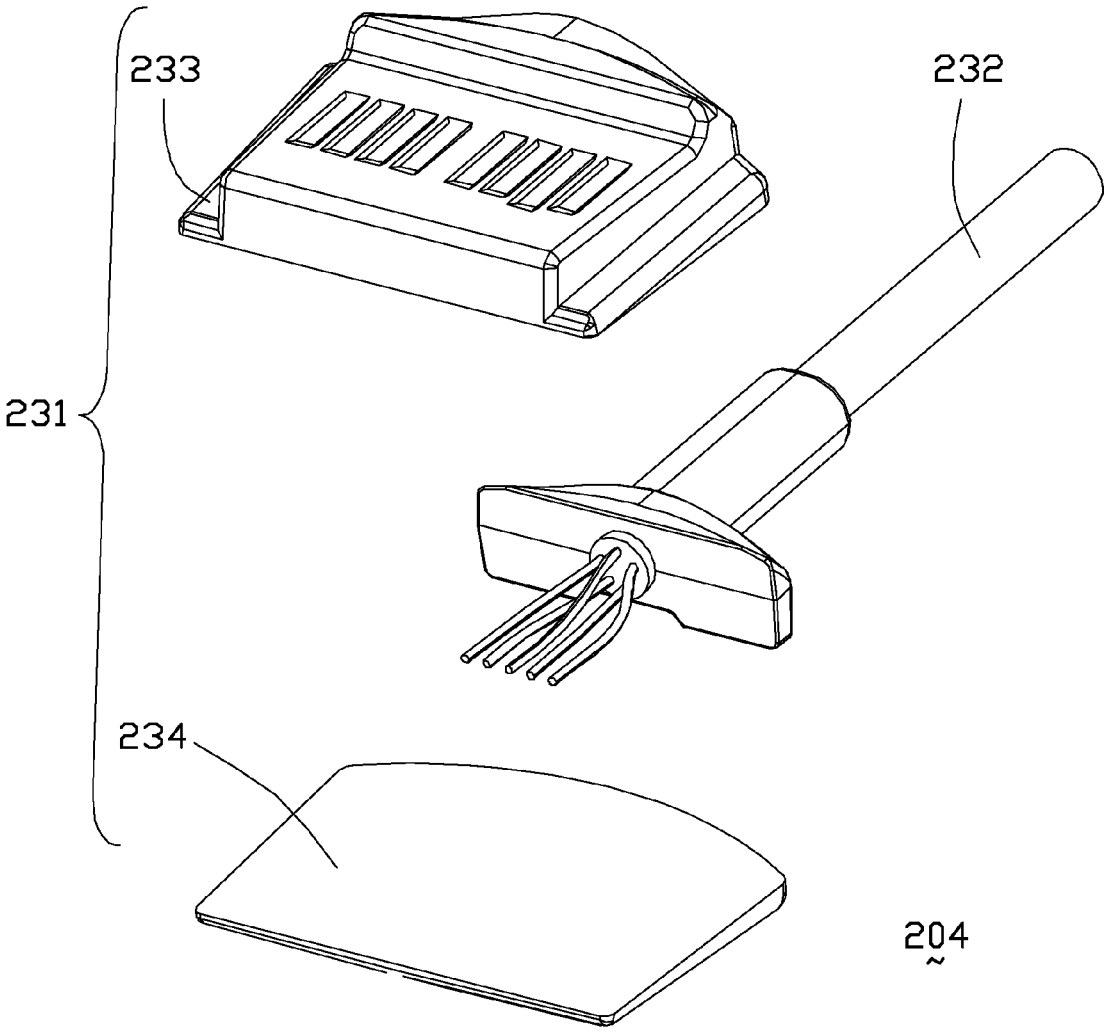
FIG. 16 is a downward exploded perspective view of another cable of FIG. 1.
Figure 17A:
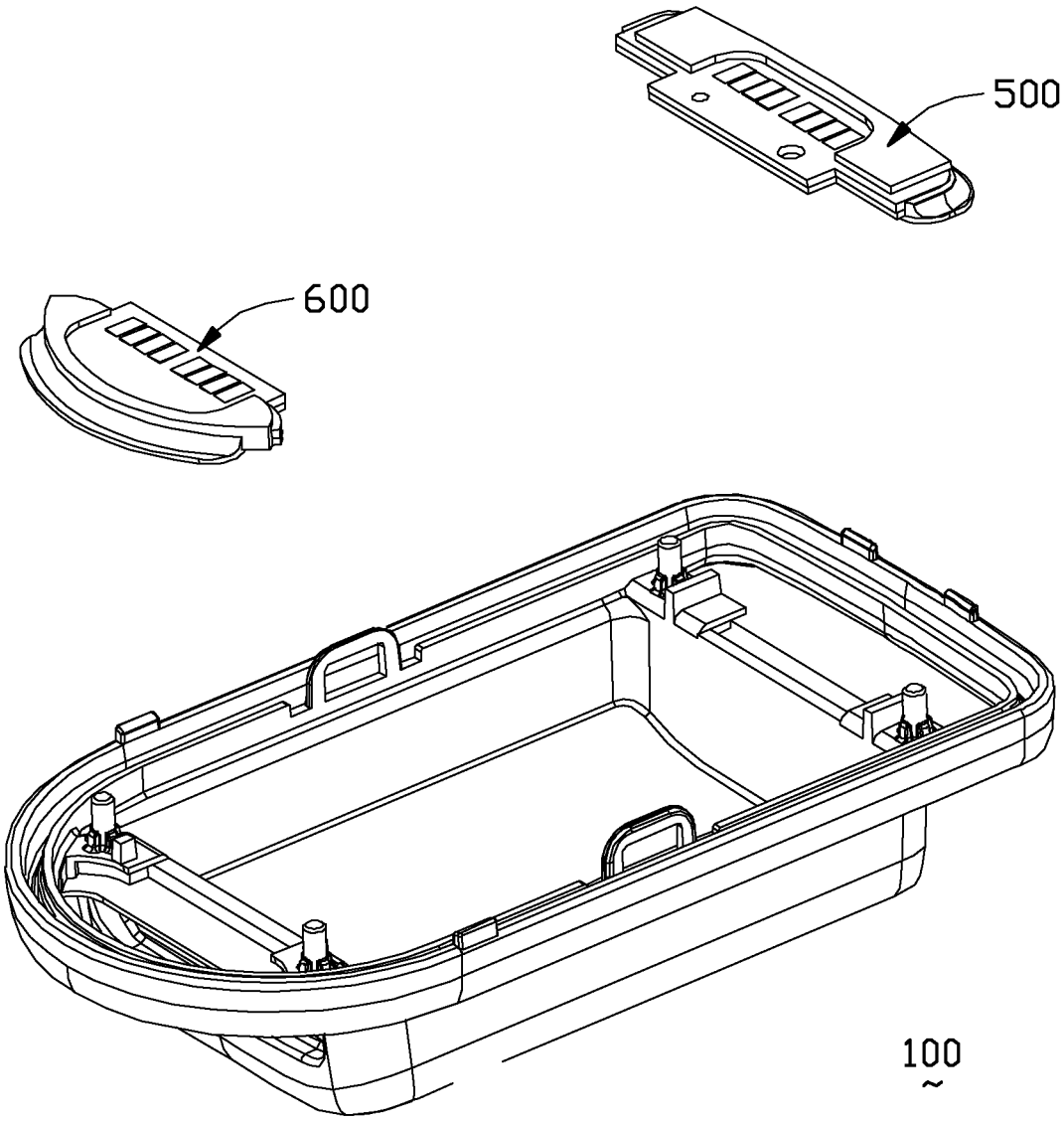
FIG. 17(A) a downward exploded perspective view of the machine case of FIG. 1 with the connector units removed therefrom.
Figure 17B:
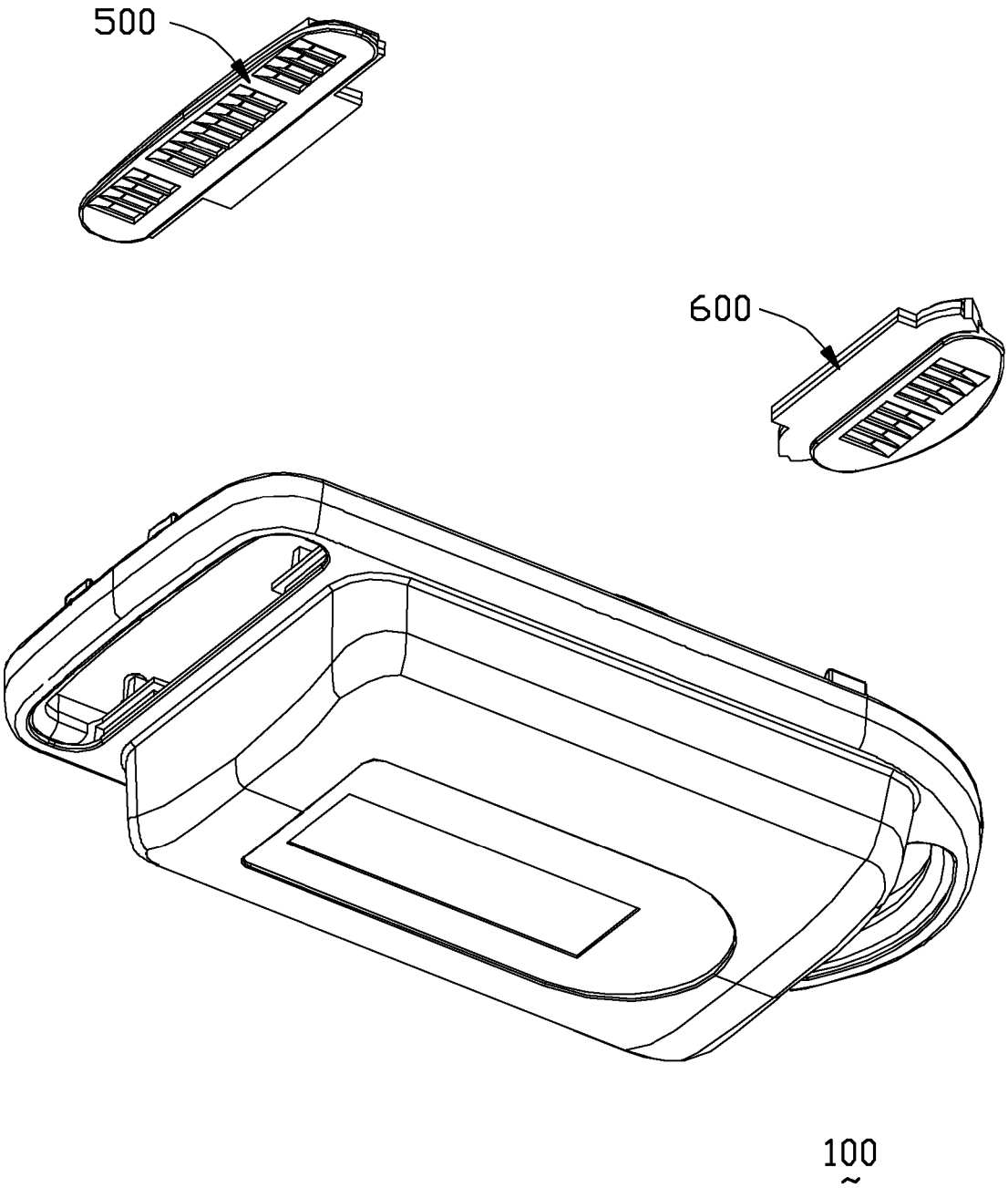
FIG. 17(B) is an upward perspective view of the machine case of FIG. 17(A).
Figure 18A:
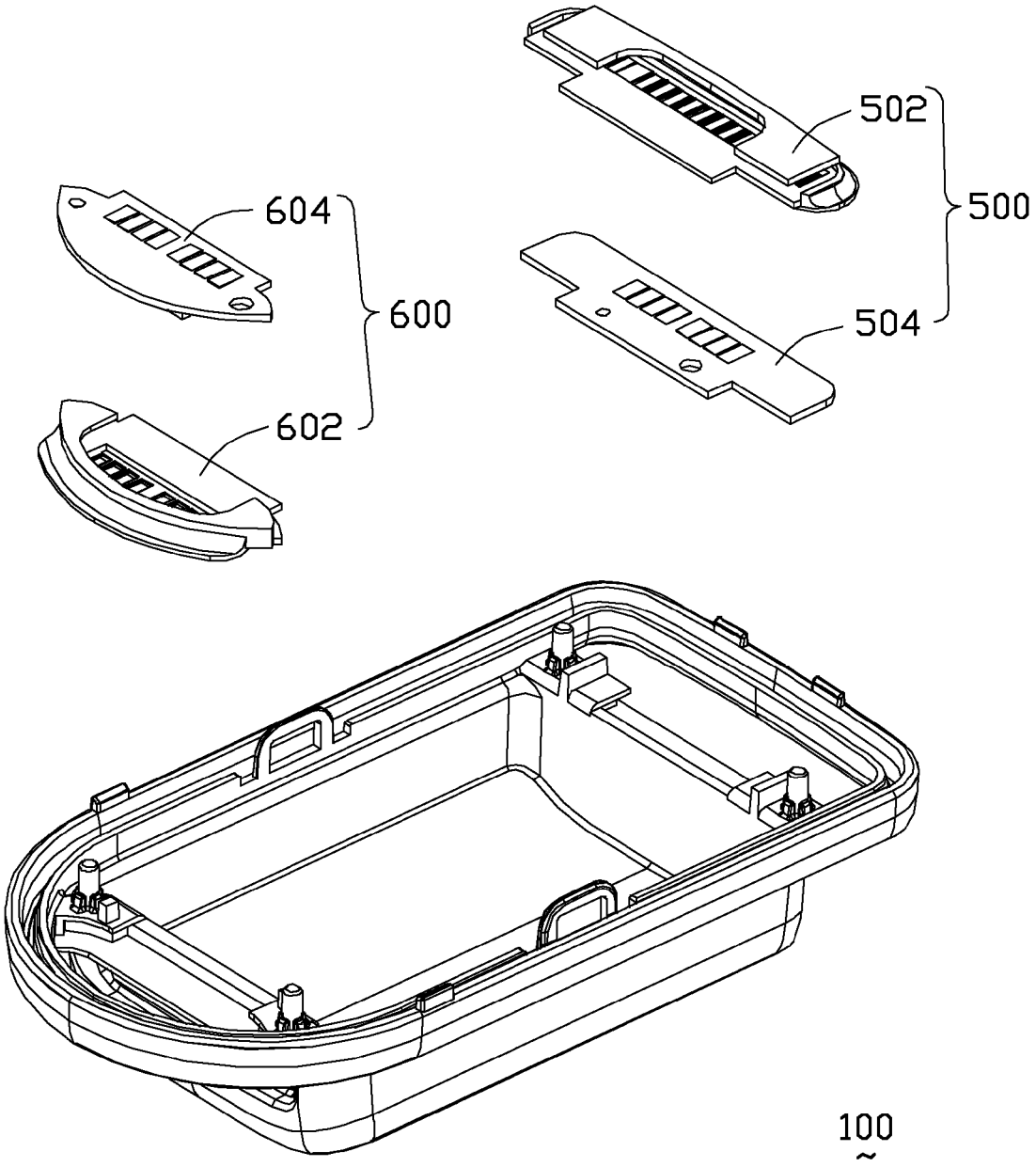
FIG. 18A) is a downward exploded perspective view of the machine case of FIG. 17(A) with the connector unit being disassembled apart.
Figure 18B:
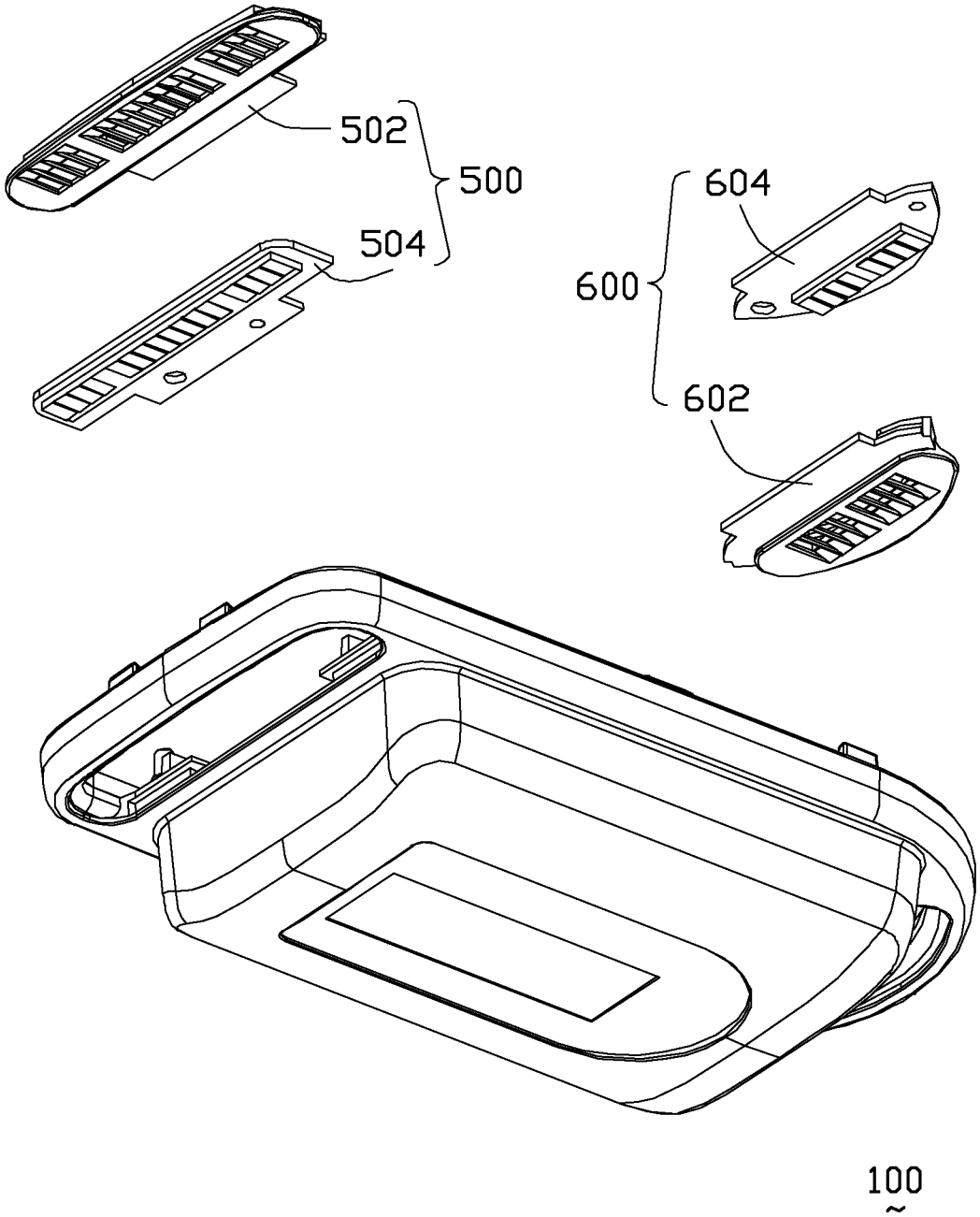
FIG. 18(B) is an upward exploded perspective view of the machine case of FIG. 18(A).

Referring to FIGS. 6-10(B), the cradle 310 is similar to the cradle 10 except the terminal module 330 and 340, wherein in the terminal module 330, in a top view the upper arm 337 of the contact 334 extends in the transverse direction relatively longer than and beyond the lower arm 349 to abut against a downward step 333 formed at the upper side of the opening 346 for preloading (FIG. 10(A)). As shown in FIGS. 9(A) and 10(B), the terminal module 340 includes the insulator 342 retaining the corresponding contacts 344 which is upwardly inserted into the opening 346, wherein the contact 344 includes a retention section 348 retained in the corresponding retention slot 341, and opposite upper arm 347 and lower arm 349. The retention section 348 includes an unexposed part 350 hidden within the retention slot 341, and an exposed part 352 beside the unexposed part 350 in a longitudinal direction of the insulator 342, and transversely exposed toward the opening 346 in a transverse direction perpendicular to said longitudinal direction, and the upper arm 347 and the lower arm 349 extend from the exposed part 352 beyond the insulator 342 in the vertical direction perpendicular to both the longitudinal direction and the transverse direction. Notably, the retention section 348 has barbed structures 350*a* and 352*a* on two opposite exterior side edges of the unexposed part 350 and the exposed part 352 in the longitudinal direction, respectively, for retaining the contact 344 in the corresponding opening 346 of the insulator 342. It is noted that similar to the retention slot 31 in the first embodiment, a portion of the retention slot 341 does not extend through the top surface of the insulator 330 so as to form a stopper of the insulator 342 downwardly abutting against a top edge of the unexposed part 350 for preventing excessive upward installation of the contact 344 into the insulator 342.

Figure 5:
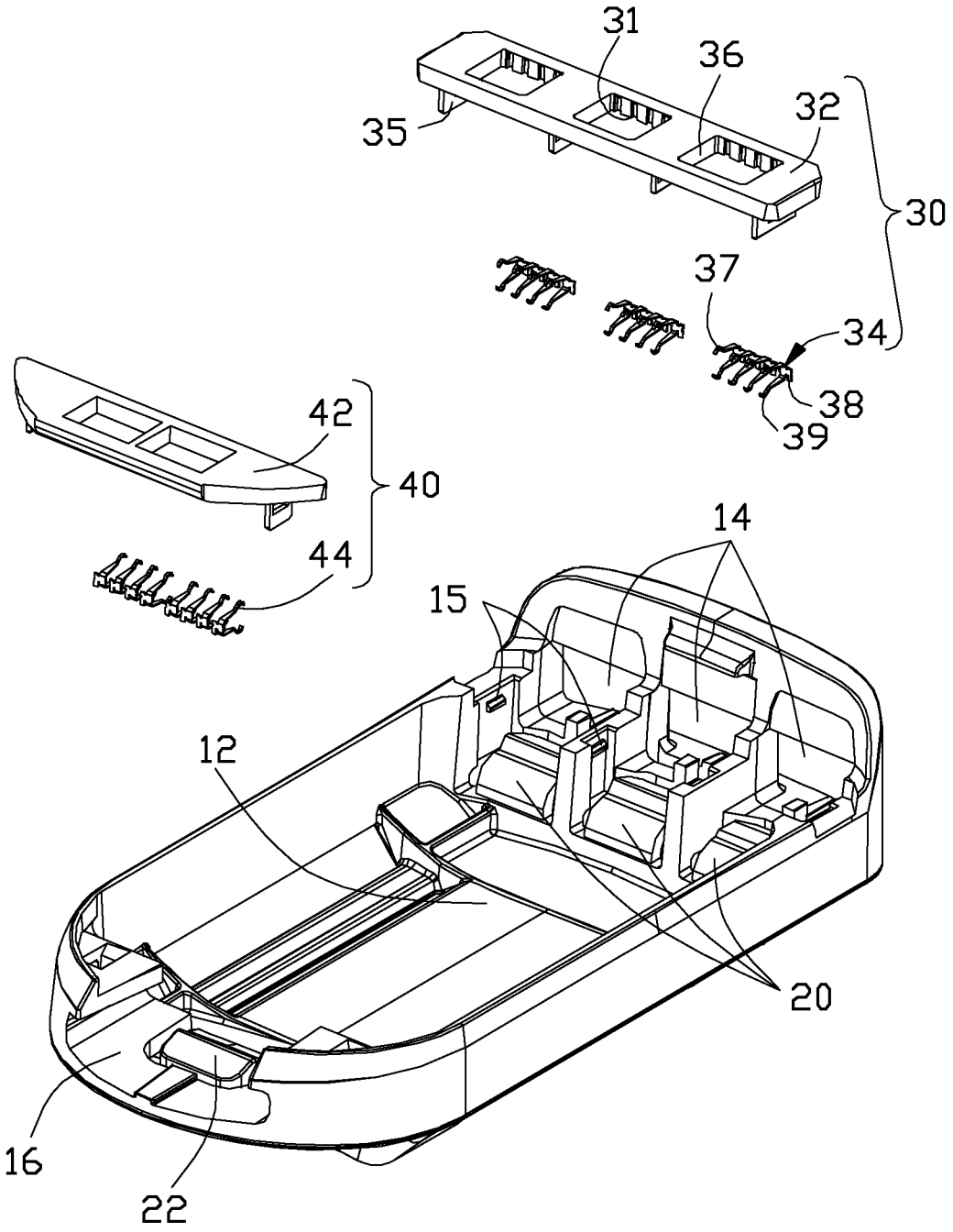
FIG. 5 is a downward exploded perspective view of the cradle of FIG. 4(A) with the contacts being taken away from the insulator of the terminal module.
Figure 6:
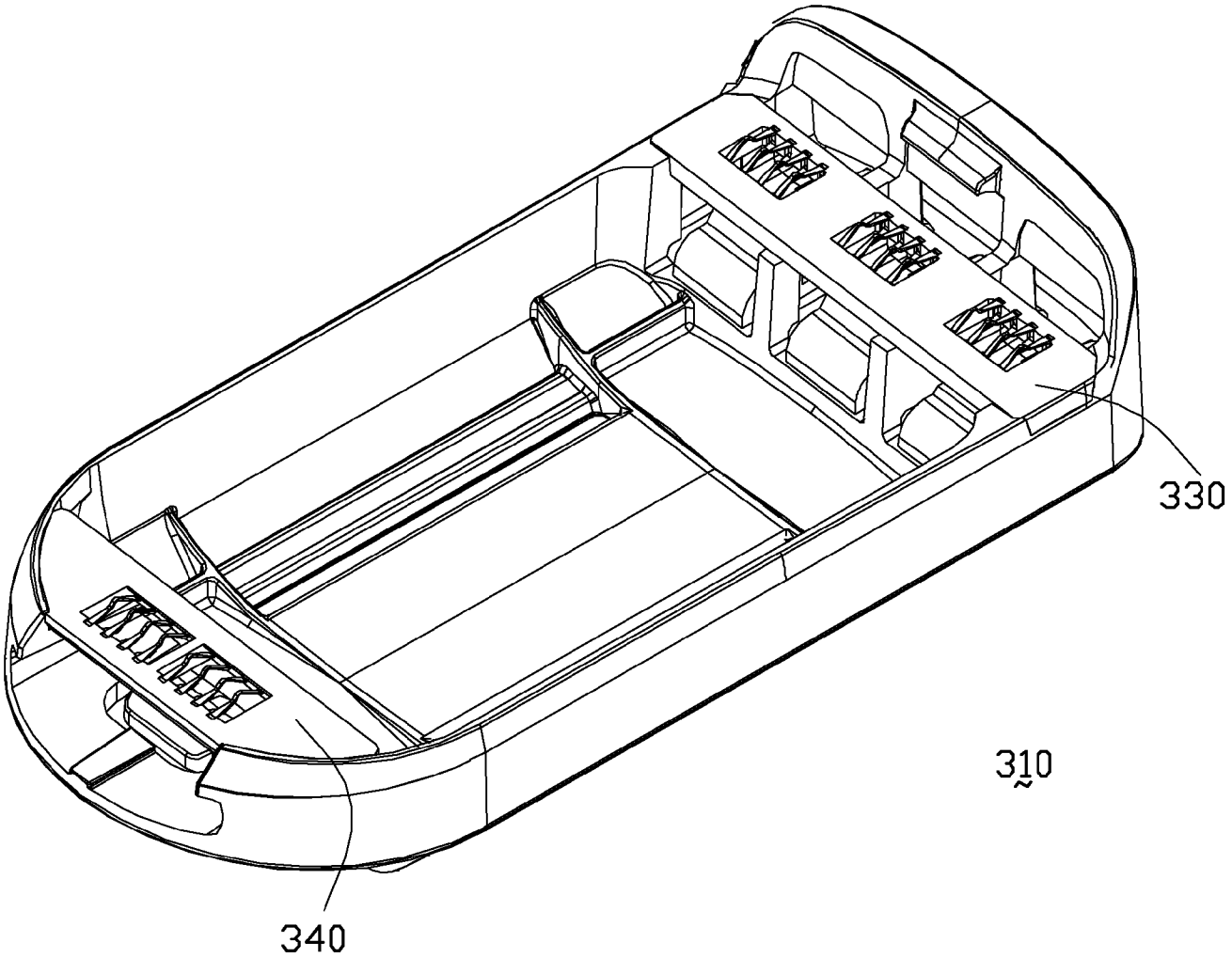
FIG. 6 is a downward perspective view of another embodiment of the cradle.
Figure 7:
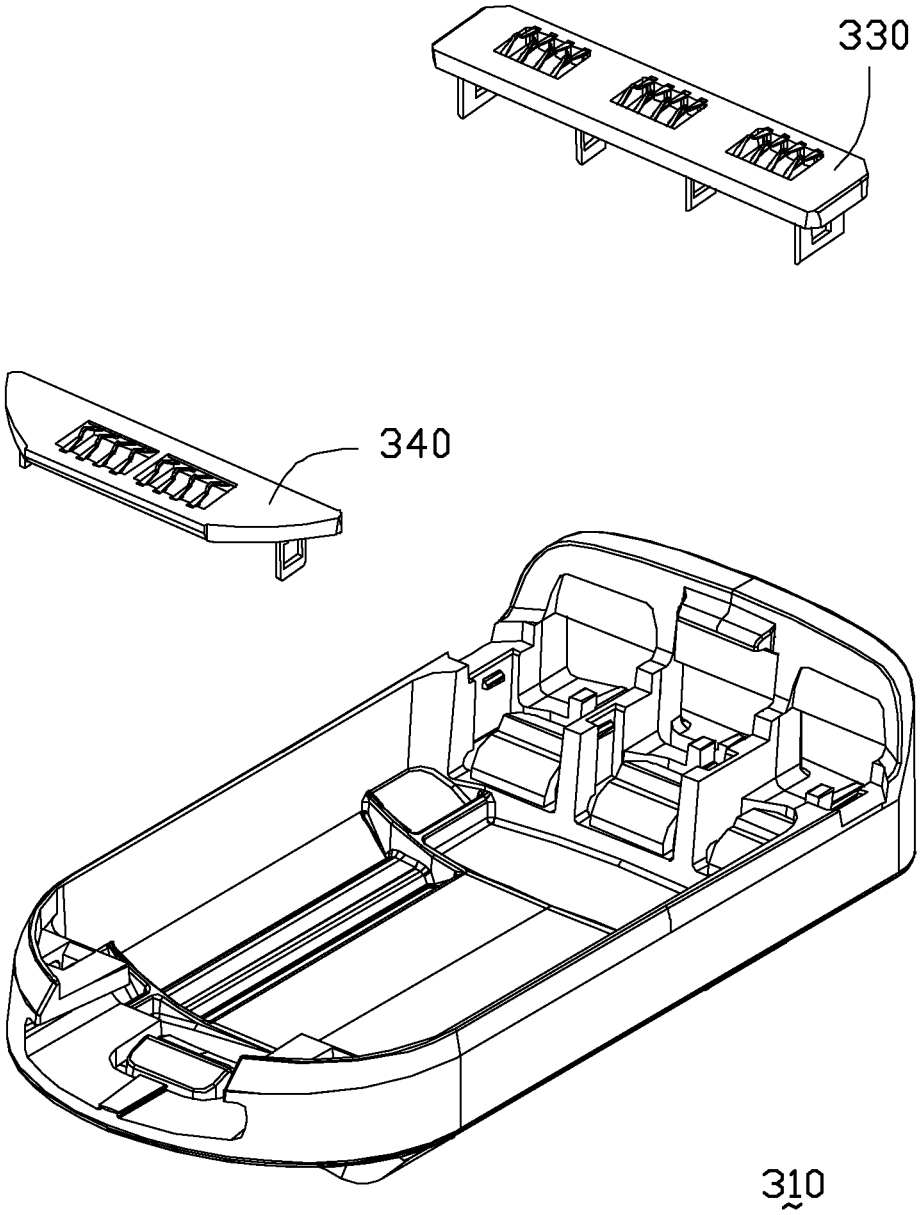
FIG. 7 is a downward exploded perspective view of the cradle of FIG. 6 with the terminal modules being disassembled therefrom.
Figure 8:
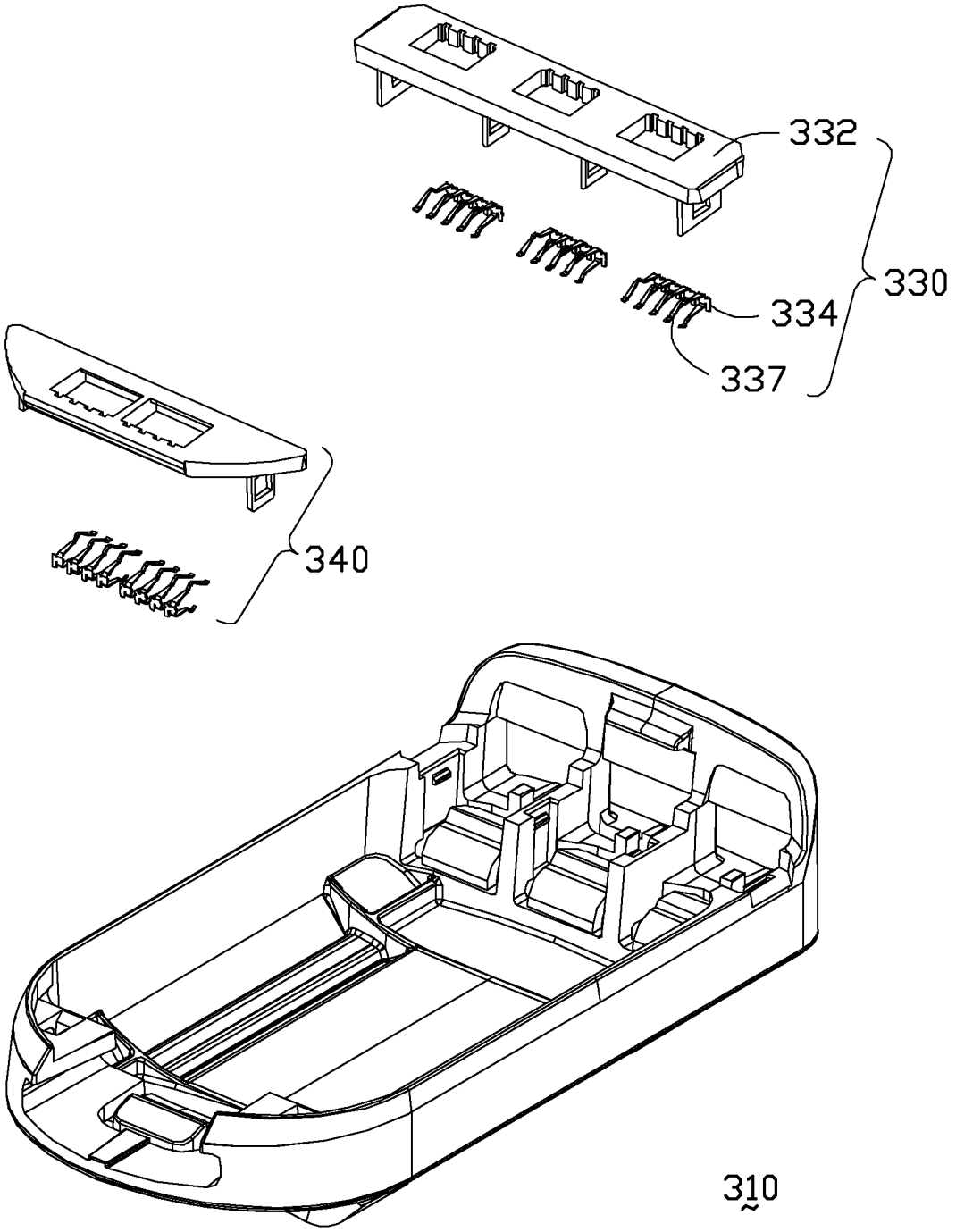
FIG. 8 is a downward exploded perspective view of the cradle of FIG. 7 with the contacts being disassembled from the terminal module.

Referring to FIGS. 11(A)-13(B), the cradle 410 is similar to the cradle 310 except the terminal module 430 and 440 wherein the insulator 432 forms a plurality of narrowed passageways 436 in alignment with the corresponding retention slots 431 and corresponding to the respective contacts 434, instead of the relatively large openings 36 each corresponding to plural contacts 34 in FIG. 5. Understandably, the narrowed passageway 436 may efficiently regulate up-and-down deflection of the corresponding contact 434, compared with the previous embodiments. The insulator 442 and the associated contacts 444 of the terminal module 440 are also arranged in the same way.

Referring to FIGS. 14(A)-16, the cable 200 includes a connector unit 211 and a wire 212 wherein the connector unit 211 is composed of a connection pad unit 213 sandwiched between upper and lower housings 214, 215. Similarly, the cable 202 includes a connector unit 221 and a wire 222 wherein the connector unit 221 is composed of a connector pad unit 223 sandwiched between the upper and lower housings 224, 225. Similarly, the cable 204 includes a connector unit 231 and a wire 232 wherein the connector unit 231 is composed of a pad unit 233 via an insert molding process, and a housing 234 assembled together.

Referring to FIGS. 17(A)-18(B), the machines case 100 is dimensioned to be snugly received in the cradle 10, wherein a first connector unit 500 is located at one end for mating with the upper arm of the terminal module 30, 330, 430, and the second connector unit 600 is located at the other end for mating with the upper arm of the terminal module 40, 340, 440. Notably, the connector unit 500 includes an inner unit 504 enclosed within an outer unit 502 via an insert molding process; similarly the connector unit 600 includes an inner unit 604 enclosed within an outer unit 602.

It should be noted that even though in the embodiment the machine case and the cradle are involved and disclosed, the instant invention is essentially and primarily related to the terminal module and the connection parts only, so other portions may be others' invention.

What is claimed is:

1. An electrical connector for use within a cradle which connects a machine case and at least one cable, comprising:

an insulator defines opposite top and bottom surfaces thereon in a vertical direction;

a plurality of contacts respectively disposed in corresponding openings of the insulator, each of said contacts including a retention section lying in a vertical plane extending along a longitudinal direction perpendicular to said vertical direction, and retainably received in a corresponding retention slot in the insulator wherein the retention slot is configured to only allow the retention section to be inserted thereinto upwardly and is equipped with a stopper around the top surface to prevent excessive upward installation of the retention section, and opposite upper and lower spring arms extending from opposite upper and lower edges of the retention section essentially along a same transverse direction perpendicular to both said vertical direction and said longitudinal direction; wherein the contacts are upwardly inserted into the openings from the bottom surface, and in a top view, the upper spring arm extends longer than and beyond the lower spring arm of the corresponding contact in the transverse direction; wherein a free end of the upper spring arm is downwardly abutted against by a step structure of the insulator while that of the lower spring arm is not.

2. The electrical connector as claimed in claim 1, wherein said insulator forms a plurality of narrowed passageways in alignment with the corresponding retention slot in the transverse direction to regulate up-and-down deflection of the upper spring arm and that of the lower spring arm.

3. The electrical connector as claimed in claim 1, wherein said insulator forms a plurality of locking lugs on the bottom surface for mounting to a housing of the cradle.

4. The electrical connector as claimed in claim 1, wherein the retention section includes an unexposed part hidden within the retention slot, and an exposed part beside the unexposed part in the longitudinal direction and transversely exposed out of the retention slot; the upper and lower spring arms extend from the respective exposed part.

5. The electrical connector as claimed in claim 4, wherein the stopper downwardly abuts against a top edge of the unexposed part of the retention section.

6. An electrical connector for use within a cradle, comprising:

an insulator defines opposite top and bottom surfaces thereon in a vertical direction, and a set of retention slots arranged at intervals in a longitudinal direction perpendicular to the vertical direction;

a plurality of contacts retained in the insulator, each of said contacts including a retention section retainably received in the corresponding retention slot, and opposite upper and lower spring arms extending along a transverse direction and protruding upwardly and downwardly beyond said top and bottom surfaces of the insulator respectively; wherein the retention section includes an unexposed part hidden within the retention slot, and an exposed part beside the unexposed part in the longitudinal direction and transversely exposed out of the retention slot; the insulator defines a stopper at upper side of the retention slot and downwardly abutting against the unexposed part; the upper and lower spring arms extend from respective upper and lower edges of the exposed part; wherein barbed structures are respectively formed on two opposite exterior side edges of said unexposed part and said exposed part in the longitudinal direction for retaining the corresponding contact in position in the insulator.

7. The electrical connector as claimed in claim 6, wherein the insulator defines a set of narrowed passageways in alignment with the corresponding retention slots and corresponding to the respective contacts; the exposed part of each contact is transversely exposed toward the passageways in the transverse direction.

8. The electrical connector as claimed in claim 6, wherein the upper spring arm is longer than the lower spring arm in the transverse direction, and the upper spring arm defines a free end downwardly abutted against by a step structure formed at the top surface of the insulator while the lower spring arm does not.

9. The electrical connector as claimed in claim 6, wherein the contacts are divided into at least two groups, the insulator defines at least two large openings corresponding to said two groups of contacts, the exposed parts of said two groups of contacts are exposed toward said two openings respectively.

10. An electrical connection system comprising:

a cradle defining an upward receiving space and at least one small cavity located at one end of the cradle along a longitudinal direction and under a corresponding deck station of said cradle, a cable connector inserted into the small cavity along said longitudinal direction, a machine case adapted to be downwardly loaded into the receiving space and equipped with a connector unit downwardly confronting the said end, both the cable connector and the connector unit providing corresponding planar contacts;

an improvement including:

a terminal module securely mounted upon the deck station and including a plurality of contacts associated with an insulator, each of said contacts having opposite resilient upper arm and lower arm respectively obliquely upward and downwardly extending to contact the corresponding connector unit and the cable connector in a compressed manner along a vertical direction perpendicular to said longitudinal direction.

11. The electrical connection system as claimed in claim 10, wherein the terminal module includes a pair of locking lugs secured to the cradle.

12. The electrical connection system as claimed in claim 10, further including means for retaining the terminal module upon the cradle in the longitudinal direction.

13. The electrical connection system as claimed in claim 10, wherein each of said contacts each including a retention section extending in a vertical plane, the corresponding upper arm and lower arm extending therefrom respectively.

14. The electrical connection system as claimed in claim 13, wherein the upper arm is downwardly pressed by a downward step of said insulator in a preloaded manner when the upper arm is free from the connector unit.

15. The electrical connection system as claimed in claim 13, wherein the retention section further includes an unexposed part abutting against the insulator the vertical direction.

16. The electrical connection system as claimed in claim 15, wherein the contact is upwardly inserted into the insulator, and the unexposed part upwardly abuts against the insulator.

17. The electrical connection system as claimed in claim 10, wherein the upper arm and the lower arm extend along the longitudinal direction.

18. The electrical connection system as claimed in claim 17, wherein the upper arm extends longer than the lower arm.

* * * * *